US008196759B2

(12) United States Patent
Milne et al.

(10) Patent No.: US 8,196,759 B2
(45) Date of Patent: Jun. 12, 2012

(54) APPARATUS FOR LABORATORY WARE

(75) Inventors: Galen Milne, Dunblane (GB); Andrew Sinclair Sherriff, Stirling (GB); William Graham Rennie, Stirling (GB); Valerie Undrill, Dunblane (GB)

(73) Assignees: Alba Scientific Services, Ltd, Pertshire (GB); Berg Design Ltd., Stirling (GB)

( * ) Notice: Subject to any disclaimer, the term of this patent is extended or adjusted under 35 U.S.C. 154(b) by 843 days.

(21) Appl. No.: 12/083,844

(22) PCT Filed: Oct. 19, 2006

(86) PCT No.: PCT/GB2006/003902

§ 371 (c)(1),
(2), (4) Date: Dec. 20, 2008

(87) PCT Pub. No.: WO2007/045888

PCT Pub. Date: Apr. 26, 2007

(65) Prior Publication Data

US 2009/0255885 A1 Oct. 15, 2009

(30) Foreign Application Priority Data

Oct. 20, 2005 (GB) ..... 0521302.0

(51) Int. Cl.
*A47F 1/04* (2006.01)

(52) U.S. Cl. ..... 211/59.2; 211/85.18

(58) Field of Classification Search ..... 211/59.2, 211/85.18; 422/526; 414/798, 798.1, 331.01, 414/331.05; 221/75, 120–122; 206/443, 206/446

See application file for complete search history.

(56) References Cited

U.S. PATENT DOCUMENTS 629,505 A * 7/1899 Hollands ..... 194/294

(Continued)

FOREIGN PATENT DOCUMENTS

FR 2600984 A1 * 1/1988

(Continued)

*Primary Examiner* — Korie Chan

(74) *Attorney, Agent, or Firm* — Drinker, Biddle & Reath, LLP

(57) ABSTRACT

A laboratory ware dispenser has a receptacle defining a space and at least one laboratory ware magazine for containing items of laboratory ware and including a plurality of apertures. The space defined by the receptacle is configured to receive the laboratory ware magazine. The receptacle has at least one aperture dimensioned such that at least one but not all of the apertures of the laboratory ware magazine are registerable with the aperture of the receptacle upon relative rotation of the receptacle and laboratory ware magazine. A laboratory ware magazine has an annular support member defining a space for containing a plurality of items of laboratory ware and a plurality of apertures arranged around a circumference of the annular support member. Each aperture is adapted to receive an item of laboratory ware, and each of the apertures is configured such that an item of laboratory ware placed in the aperture is directed radially inward of the annular support member into the space and is retained in the aperture. Laboratory ware magazines can be stacked to create a plurality of laboratory ware magazines.

19 Claims, 19 Drawing Sheets

U.S. PATENT DOCUMENTS

| | | | | | |
|---|---|---|---|---|---|
| 736,980 | A | * | 8/1903 | Kneedler | 221/121 |
| 1,125,653 | A | * | 1/1915 | Clark | 221/75 |
| 2,581,170 | A | * | 1/1952 | Carlson | 221/121 |
| 4,159,783 | A | * | 7/1979 | Crasnianski | 221/13 |
| 4,498,603 | A | * | 2/1985 | Wittenborg | 221/76 |
| 4,686,121 | A | * | 8/1987 | Rogalla | 427/378 |
| 4,846,367 | A | * | 7/1989 | Guigan et al. | 221/81 |
| 5,393,039 | A | * | 2/1995 | Smith | 266/261 |
| 5,450,160 | A | * | 9/1995 | Tianello et al. | 396/564 |
| 5,988,431 | A | * | 11/1999 | Roe | 221/132 |

FOREIGN PATENT DOCUMENTS

| | | | | |
|---|---|---|---|---|
| WO | WO 92/04255 | A1 | | 3/1992 |
| WO | WO 9204255 | A1 | * | 3/1992 |
| WO | WO 96/26788 | A1 | | 9/1996 |
| WO | WO 9626788 | A1 | * | 9/1996 |

* cited by examiner

Fig. 9
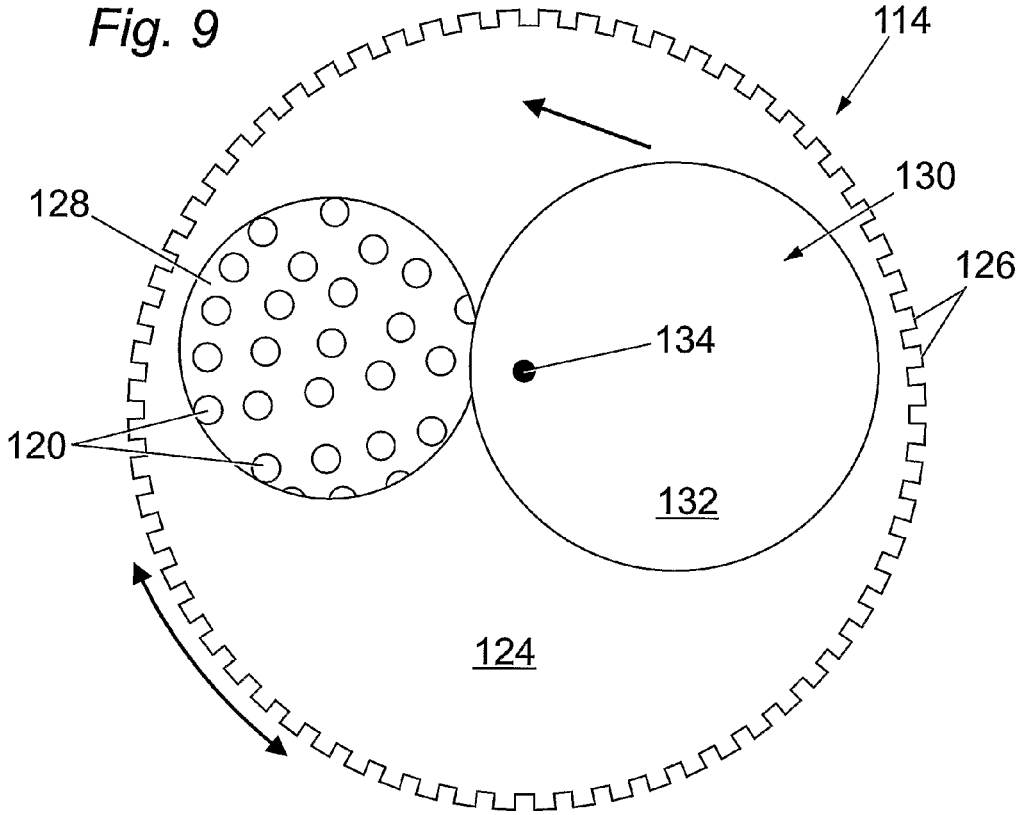
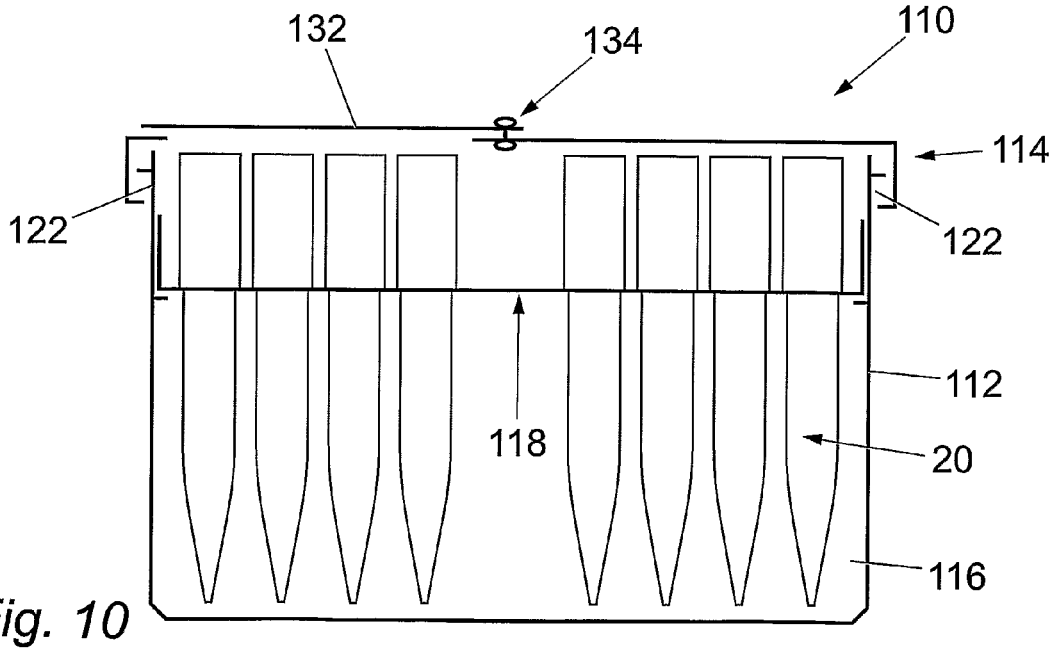
Fig. 10

APPARATUS FOR LABORATORY WARE

The present invention relates to laboratory ware magazines, laboratory ware magazine stacks and laboratory ware dispensers.

Pipette tips are used widely in laboratories. In the laboratory pipette tips are often stored in dispensers that provide protection from contamination whilst allowing for ease of access when the tips are to be put into use. Sometimes suitable dispensers are improvised from items readily to hand, e.g. by covering a laboratory beaker with foil or by using a redundant coffee jar. Alternatively, purpose-built dispensers may be used. Such purpose-built dispensers are normally of rectangular footprint and covered by a lift-off or hinged lid. However, upon removal of the lid of such a dispenser all the stored tips are exposed to potential contamination, which may be disadvantageous in certain circumstances.

Rectangular purpose-built dispensers with sliding lids are known. In use, the lid of such a dispenser is slid to one side or the other to allow for the removal of some of the stored pipette tips whilst protecting the other tips from contamination.

The present inventor has appreciated that known pipette tip dispensers have shortcomings. More specifically, purpose-built dispensers with sliding lids tend not to provide for quick and easy access to a limited number of stored tips at any one time. Also, such dispensers tend not to allow for ease of single handed operation of the lid to gain access to successive batches of stored tips without jeopardising the sterility of all the stored tips.

In addition it will be appreciated that known pipette tip dispensers of rectangular footprint take up an area of work surface commensurate with that footprint and, therefore, when a large number of pipette tips are required for use at the same time, for example when robotic pipetting machinery is to be employed, a relatively large footprint area is required to house the pipette tip dispensers. Further, when multi-channel pipettes are used, either manual or automated, the contents of known pipette tip dispensers are emptied relatively rapidly due to the limited pipette tip storage capacity.

In view of these shortcomings the present inventor has devised the present invention in accordance with a first aspect of which there is provided a laboratory ware magazine comprising:

an annular support member defining a space for containing a plurality of items of laboratory ware;

a plurality of apertures arranged around a circumference of the annular support member, each aperture being adapted to receive an item of laboratory ware; and each of said apertures being configured such that an item of laboratory ware placed in the aperture is directed radially inwardly of the annular support member into the space and is retained in the aperture.

The space defined by the annular support member is preferably cylindrical. The cylindrical space defined by the annular support member is bounded by top and bottom end planes and a circumferential surface provided by the annular support member. The top and bottom planes are preferably parallel with one another. The terms "top" and "bottom" are not to be taken as implying any specific orientation to the laboratory ware magazine unless otherwise stated.

The laboratory ware magazine may further comprise ware retaining members extending radially of the annular support member. Advantageously the laboratory ware magazine comprises a series of ware retaining members extending radially of the annular support member.

In one embodiment of the invention the ware retaining members are planar lugs arranged to project radially outwardly of the circumferential surface of the annular support member in a plane perpendicular to the top and/or bottom end planes of the cylindrical space defined by the annular support member.

More specifically, a pair of ware retaining members or lips may be located at opposing sides of an aperture and may provide further support for an item of laboratory ware retained in the aperture.

Alternatively, or in addition, the annular support member may define a plurality of bores extending through the annular support member each bore being of non-uniform diameter along its length for receiving an item of laboratory ware. In this arrangement the bore forms an aperture in the annular support member.

More specifically, each bore may define a rim extending radially into the bore and located towards one end of the bore. Thus, the rim may restrict the diameter of the bore towards one end of the bore.

Thus, the bore or ware retaining members are configured to retain an item of laboratory ware in the annular support member thereby preventing spillage of the item from the laboratory ware magazine due to the effects of gravity.

In order to provide further strength and support to the laboratory ware magazine, the laboratory ware magazine may further comprise a support rim-arranged to couple a plurality of ware retaining members whilst not hindering access to the aperture of the laboratory ware magazine.

The support rim may be located in parallel configuration with the top and/or bottom end planes of the cylindrical space defined by the annular support member.

The support rim may be of annular configuration. In one embodiment of the present invention the support rim forms a flange which extends radially outwardly of, and is perpendicular to, the circumferential surface of the annular support member.

The laboratory ware magazine may comprise a plurality of support rims arranged to couple a plurality of ware retaining members.

More specifically, the support rim(s) of the laboratory ware magazine is/are co-planar with, or parallel to the top and/or bottom end plane of the cylindrical space defined by the annular support member.

More specifically, the support rims may have an equal or unequal annular diameter.

The laboratory ware magazine may comprise two support rims.

When the laboratory ware magazine comprises two support rims, the first support rim may be located adjacent to the top end of the cylindrical space and a second support rim being located adjacent to the bottom end of the cylindrical space defined by the annular support member, the two support rims being in parallel configuration with one another.

The laboratory ware magazine may comprise at least one further support rim located adjacent to the top and/or the bottom end of the cylindrical space defined by the annular support member, the further support rim(s) being of a different annular diameter to at least one of the first and second support rims.

The apertures of the laboratory ware magazine are arranged on the circumferential surface of the cylinder defined by the annular support member. In use, an item of laboratory ware retained in an aperture is directed radially inwardly of the annular support member such that it projects into the cylindrical space defined by the annular support member. More specifically, the item of laboratory ware will project towards the centre point of the space defined by the annular support member such that the body of the item of laboratory ware is retained within the cylindrical space bounded by the top and bottom end planes and the circumferential surface.

The laboratory ware magazine is configured to receive a plurality of items of laboratory ware which plurality shall also be referred to herein as an array. In use, the array of items of laboratory ware is retained within the space defined by the annular member. Preferably the array does not protrude radially outwardly of the annular support member. Preferably the array of items of laboratory ware is retained wholly within the annular support member and the space defined thereby. Alternatively, when the laboratory ware magazine comprises ware retaining members extending radially outwardly of the annular support member, the array of items of laboratory ware are retained such that they do not project radially outwardly of the annular support member beyond the extent of the ware retaining members. Thus, the array is retained within the outer radial bounds of the laboratory ware magazine.

The annular support member of the laboratory ware magazine comprises a plurality of apertures arranged around a circumference. In one embodiment of the present invention the width dimension of the annular support member is sufficient to provide for a single circumference therearound and, thus, for a single array of items of laboratory ware around the annular support member. When referred to herein a "width dimension" of the annular support member is the dimension of the circumferential surface of the annular support member as measured between the intersections of the circumferential surface and the top and bottom end planes respectively along a longitudinal axis of the annular support member perpendicular to the end planes.

Alternatively, the width dimension of the annular support member may comprise a plurality of circumferences, each circumference having a plurality of apertures arranged thereabout. Thus, in use, the laboratory ware magazine comprises a series of arrays of items of laboratory ware arranged around the annular support member, each array being arranged around a single circumference, the arrays being in parallel configuration with one another.

It will be understood that the number of circumferences around the annular support member and, hence (in use) the number of arrays of items of laboratory ware, will be a matter of design choice and can be selected to provide a laboratory ware dispenser of any desired storage capacity. Thus, the width dimension of the annular support member is scalable to provide a laboratory ware magazine having the desired storage capacity for items of laboratory ware.

In addition to the scalability of the width dimension of the annular support member, the number and size of apertures around a circumference of the annular support member will be a matter of design choice and will depend upon the size of the item to be retained within the aperture. For example, pipette tips of vastly varying sizes are available to the consumer and the apertures in the annular support member of the laboratory ware magazine of the present invention are scaleable to retain a wide variety of sizes of pipette tip.

In one arrangement, the laboratory ware magazine comprises between 1 and 12 circumferences and may comprise 480 apertures for retaining items of laboratory ware. In this embodiment of the laboratory ware magazine of the present invention, each circumference of the annular support member may have 40 apertures arranged thereabout.

It is much by preference that when the annular support member comprises a plurality of circumferences, the apertures in adjacent circumferences are axially aligned with one another along a longitudinal axis parallel to the longitudinal axis of the cylindrical space defined by the annular support member and perpendicular to the top and/or bottom end planes of the cylindrical space.

The annular configuration of the laboratory ware magazine allows for a large storage capacity relative to the footprint of the magazine. It will be well understood that the number and size of apertures and/or the diameter of the annular support member are scalable to accommodate different sizes and/or different numbers of items of laboratory ware.

The apertures may be configured such that they support a plurality of items each having a tapering body.

Preferably the laboratory ware magazine is configured to contain pipette tips. Alternatively, or in addition, the laboratory ware magazine is configured to receive microtubes. Other suitable items of laboratory ware will be within the understanding of the skilled person.

The laboratory ware magazine may be configured to accommodate a plurality of different sizes of pipette tips, such as yellow tips, which are typically of 8 to 9 mm diameter, and blue tips, which are typically of 9 to 10 mm diameter, and having a fluid volume typically in the ranges of 1-200 μl and 101-1000 μl respectively. It will be understood that the laboratory ware magazine may be configured to accommodate pipette tips of the same size or, alternatively may be configured to accommodate a plurality of different tip sizes within the same laboratory ware magazine. It will be further understood that the laboratory ware magazine is scaleable to retain any size of pipette tip.

The laboratory ware magazine may further comprise magazine retaining means configured to engage with a further laboratory ware magazine.

The laboratory ware magazine may comprise magazine retaining means configured to engage with the magazine retaining means of the further laboratory ware magazine.

The magazine retaining means may be configured to provide for releasable coupling or, alternatively, may be configured to provide for fixed coupling of a further laboratory ware magazine. In the latter configuration it will be understood that once the magazine retaining means have been engaged for a first time, the laboratory ware magazines will effectively be locked together.

The magazine retaining means may be arranged on a flange of the laboratory ware magazine, the flange being directed radially inwardly of the annular support member. Preferably the flange depends from the annular support member and is perpendicular to the circumferential surface of the annular support member Alternatively, or in addition, the flange may be directed radially outwardly of the annular support member. In this arrangement the radially outwardly directed flange may be the same as the support rim of the laboratory ware magazine or, alternatively, may be in addition to the support rim.

The laboratory ware magazine may comprise a first and a second flange each directed radially inwardly, and/or radially outwardly, of the annular support member.

The first and the second flanges may be arranged adjacent to the top and bottom ends of the cylinder provided by the annular support member.

When directed radially inwardly of the annular support member the first and the second flange may form parallel upper and lower end surfaces of the laboratory ware magazine respectively. When referred to herein, the terms upper and lower should be taken to mean the opposing ends of a cylinder defined by the annular support member and the radially inwardly directed flanges of the annular support member and should not be taken as implying any orientation of the laboratory ware magazine.

The flange of the laboratory ware magazine may form a complete end surface thereby closing an end of the cylindrical space defined by the annular member or, alternatively, may form a partial surface covering only a part of the end of the cylindrical space defined by the annular support member.

In a further alternative the flange may be provided by one or more lugs extending radially inwardly and/or radially outwardly of the annular support member. When there is more than one lug, the lugs are preferably circumferentially spaced from one another around the annular support member.

The magazine retaining means of a laboratory ware magazine may be comprised of opposing magazine retaining members wherein the first flange of the annular support member comprises a first magazine retaining member and the second flange of the annular support member comprises a second magazine retaining member, the first and/or second magazine retaining member being engageable with an opposing magazine retaining member on an adjacent laboratory ware magazine so as to couple together adjacent laboratory ware magazines. Thus, for example, a first magazine retaining member of a first flange of an annular support member is engageable with a second magazine retaining member of a second flange of an adjacent annular support member thereby coupling the adjacent annular support members.

In one embodiment of the present invention the opposing magazine retaining members may comprise a tongue arranged on the first flange of the annular support member and of a groove arranged on the second flange of the annular support member. Thus, a tongue from a first laboratory ware magazine will be engageable with a groove from a second laboratory ware magazine thereby forming a laboratory ware magazine stack. Other suitable magazine retaining means will be well known to those skilled in the art and may comprise a thread and screw arrangement, or a pin and hole arrangement for example.

The laboratory ware magazine may further comprise a detent configured to provide radial positioning of the laboratory ware magazine within a receptacle.

The laboratory ware magazine may even further comprise an alignment means configured to enable positional placement of one laboratory ware magazine relative to another.

The alignment means may comprise a lug projecting from the annular support member. Preferably the lug projects radially inwardly of the annular support member into the space defined thereby so as to be visible in the space. The lug may be a planar member projecting radially inwardly of the annular support member in a plane parallel to the top and/or bottom end plane of the cylindrical space defined by the annular support member. During assembly of a plurality of laboratory ware magazines, the magazines may be brought into proximity with one another and, may be positioned and orientated correctly relative to one another by way of aligning the alignment means of each laboratory ware magazine before being engaged with one another.

Alternative alignment means may be a detent provided on a rim of a first annular support member and a corresponding indent provided on a rim of a second annular support member, the detent and indent being positioned on their respective rims so as to engage with one another when the adjacent rims of the annular support members are correctly aligned with one another. Other suitable alignment means will be known to the skilled artisan.

In a second aspect, the present invention further provides a laboratory ware magazine stack comprising a plurality of laboratory ware magazines.

It is much by preference that the laboratory ware magazine stack comprises a plurality of laboratory ware magazines according to the previously described first aspect of the present invention.

The space defined by the laboratory ware magazine stack is preferably cylindrical. The cylindrical space defined by the laboratory ware magazine stack is bounded by top and bottom end planes and a circumferential surface provided by the annular support members of the laboratory ware magazines from which the laboratory ware magazine stack is comprised. The top and bottom planes are preferably parallel with one another. The terms "top" and "bottom" are not to be taken as implying any specific orientation to the laboratory ware magazine stack unless otherwise stated.

More specifically, the laboratory ware magazine stack comprises a plurality of laboratory ware magazines arranged in alignment with one another along an axis formed longitudinally through the centre points of the cylindrical spaces defined by each annular support member. By way of the axial alignment of a plurality of laboratory ware magazines an elongate cylindrical laboratory ware magazine stack is provided.

The elongate cylindrical laboratory ware magazine stack defines a cylindrical space comprising top and bottom end planes and a circumferential surface. The circumferential surface of the elongate laboratory ware magazine stack has a width dimension comprised of the sum of the width dimensions of each of the laboratory ware magazines which comprise the laboratory ware magazine stack. Each laboratory ware magazine may have an equal or unequal width dimension within the laboratory ware magazine stack.

Preferably each and all of the laboratory ware magazines within the laboratory ware magazine stack have an equal annular diameter.

It is much by preference that the laboratory ware magazines of which the laboratory ware magazine stack is comprised are identical.

Alternatively, or in addition, some or all of the laboratory ware magazines within the laboratory ware magazine stack may comprise different annular diameters. In the latter arrangement, the laboratory ware magazine stack will have a frustoconical shape and will define a frustoconical space.

It will be understood that the number and annular diameter of laboratory ware magazines configured to provide the laboratory ware magazine stack of the invention will be a matter of design choice and can be selected to provide a laboratory ware magazine stack of any desired storage capacity. Thus, the number and annular diameter of laboratory ware magazines within the stack are scaleable to provide the desired storage capacity and to retain the desired size of laboratory ware. For example, when the laboratory ware magazine stack is configured for use in a robotic, automated machine, the required storage capacity will be larger than if the laboratory ware magazine stack is configured for use by an individual consumer at a work bench.

In one arrangement, the laboratory ware magazine stack will comprise between 2 and 12 laboratory ware magazines.

Within the laboratory ware magazine stack, a laboratory ware magazine may further comprise magazine retaining means configured to engage an adjacent laboratory ware magazine.

Preferably a laboratory ware magazine may comprise magazine retaining means configured to engage with magazine retaining means of an adjacent laboratory ware magazine.

The magazine retaining means are operable to couple adjacent laboratory ware magazines.

Thus, when a plurality of laboratory ware magazines are brought together to form a laboratory ware magazine stack the magazine retaining means of the magazine, or alternatively the magazine retaining means of adjacent magazines, engage with an adjacent magazine, or with one another respectively, to couple the adjacent magazines.

The magazine retaining means may be configured to provide for releasable coupling or, alternatively, may be configured to provide for fixed coupling of adjacent laboratory ware magazines. In the latter configuration it will be understood that once the magazine retaining means have been engaged for a first time, the adjacent laboratory ware magazines will effectively be locked together.

The magazine retaining means may be arranged on a flange of the laboratory ware magazine, the flange being directed radially inwardly and/or radially outwardly of the annular support member.

When the laboratory ware magazine comprises a first and a second flange each directed radially inwardly of the annular support member, the flanges form parallel upper and lower end surfaces of the laboratory ware magazine respectively. When referred to herein, the terms upper and lower should be taken to mean the opposing ends of a cylinder defined by the annular support member and the radially inwardly directed flanges of the annular support member and should not be taken as implying any orientation of the laboratory ware magazine.

The flange of the laboratory ware magazine may form a complete end surface thereby closing an end of the cylindrical space defined by the annular member or, alternatively, may form a partial surface covering only a part of the end of the cylindrical space defined by the annular support member.

In a further alternative the flange may be provided by one or more lugs extending radially inwardly and/or outwardly of the annular support member. When there is more than one lug, the lugs are preferably circumferentially spaced from one another around the annular support member.

The magazine retaining means of a laboratory ware magazine may be comprised of opposing magazine retaining members wherein the first flange of the annular support member comprises a first magazine retaining member and the second flange of the annular support member comprises a second magazine retaining member, the first and/or second magazine retaining member being engageable with an opposing magazine retaining member on an adjacent laboratory ware magazine so as to couple together adjacent laboratory ware magazines. Thus, for example, a first magazine retaining member of a first flange of an annular support member is engageable with a second magazine retaining member of a second flange of an adjacent annular support member thereby coupling the adjacent annular support members.

In one embodiment of the present invention the opposing magazine retaining members may comprise a tongue arranged on the first flange of the annular support member and of a groove arranged on the second flange of the annular support member. Thus, a tongue from a first laboratory ware magazine will be engageable with a groove from a second laboratory ware magazine thereby forming a laboratory ware magazine stack. Other suitable magazine retaining means will be well known to those skilled in the art and may comprise a thread and screw arrangement, or a pin and hole arrangement, for example.

When the laboratory ware magazine comprises a support rim to provide further strength and support thereto, such that the annular support member comprises a support rim arranged to couple a plurality of ware retaining members at an outer edge thereof whilst not hindering access to the aperture of the laboratory ware magazine, the support rim may further provide a surface upon which the magazine retaining member(s) of the laboratory ware magazine are located. Alternatively, the magazine retaining member(s) may be located on a separate flange.

Thus, the support rim, or flange, providing additional strength and support and coupling a plurality of ware retaining members, and the flange upon which the magazine retaining members are located may be one and the same.

Each laboratory ware magazine may even further comprise an alignment means configured to enable positional placement of one laboratory ware magazine relative to another.

The alignment means may comprise a lug projecting from the annular support member. Preferably the lug projects radially inwardly of the annular support member into the space defined thereby so as to be visible in the space. The lug may project radially inwardly of the annular support member in a plane parallel to the top and/or bottom end plane of the cylindrical space defined by the annular support member. During assembly of the laboratory ware magazine stack a plurality of laboratory ware magazines may be brought into proximity with one another and, may be positioned and orientated correctly relative to one another by way of aligning the alignment means of each laboratory ware magazine before being engaged with one another.

Alternative alignment means may be a detent provided on a rim of a first annular support member and a corresponding indent provided on a rim of a second annular support member, the detent and indent being positioned on their respective rims so as to engage with one another when the adjacent rims of the annular support members are correctly aligned with one another. Other suitable alignment means will be known to the skilled artisan and may include a pin and hole arrangement, for example.

In a third aspect the present invention there is provided a laboratory ware dispenser comprising:

a receptacle defining a space;

at least one laboratory ware magazine for containing items of laboratory ware and comprising a plurality of apertures;

the space defined by the receptacle being configured to receive the laboratory ware magazine; and the receptacle comprising at least one aperture in a surface thereof the aperture being dimensioned such that at least one but not all of the apertures of the laboratory ware magazine are registerable with the aperture of the receptacle upon relative rotation of the receptacle and laboratory ware magazine.

Thus, in use, the registration of an aperture of the laboratory ware magazine and the receptacle provides for the selective removal of at least one item of laboratory ware contained within the space.

Preferably the laboratory ware magazine is a laboratory ware magazine according to the first aspect of the present invention.

Preferably the receptacle is adapted to receive a laboratory ware magazine stack according to the second aspect of the present invention.

More specifically the receptacle provides a cylindrical container adapted to receive at least one laboratory ware magazine or a laboratory ware magazine stack according to the invention. The receptacle is advantageously a cylindrical dispenser, open at a first end, comprising a circumferential outer surface and a bottom wall, the bottom wall closing the dispenser at a second end. The first and second ends are most preferably parallel with one another.

The receptacle may comprise a plurality of apertures. The plurality of apertures is preferably arranged longitudinally of the receptacle. More specifically the plurality of apertures may be arranged in longitudinal alignment with one another on an axis parallel to the longitudinal axis of the cylinder defined by the receptacle. The apertures provide access to the space defined by the receptacle. Each of the apertures of the receptacle is configured to register with an aperture in a laboratory ware magazine or stack within the receptacle.

The receptacle may comprise a plurality of rows of apertures. Each row may comprise a plurality of apertures arranged in longitudinal alignment with one another on an axis parallel to the longitudinal axis of the cylinder defined by the receptacle.

The plurality of rows of apertures may be circumferentially spaced from one another in the outer surface of the receptacle.

Each of the apertures in the row or rows provided in the receptacle are registerable with an aperture in the laboratory ware magazine or laboratory ware magazine stack contained within the receptacle. Thus, in, use, an item of laboratory ware retained within an aperture in the laboratory ware magazine or laboratory ware magazine stack is removable therefrom through the corresponding aperture in the receptacle.

The laboratory ware dispenser may comprise a receptacle having apertures corresponding in number to those in the laboratory ware magazine or laboratory ware magazine stack receivable in the receptacle and being registerable therewith. In this embodiment access to each and all of the items retained within the laboratory ware magazine or laboratory ware magazine stack may be achieved contemporaneously.

Alternatively, the laboratory ware dispenser may comprise a receptacle having fewer apertures than the laboratory ware magazine or laboratory ware magazine stack receivable in the receptacle such that populations of apertures in the laboratory ware magazine or laboratory ware magazine stack may be brought into registration with the apertures in the receptacle consecutively in order to provide access to the items of laboratory ware retained within the laboratory ware magazine or laboratory ware magazine stack.

In a preferred embodiment of the present invention the receptacle comprises two rows of longitudinally aligned apertures. The two rows of apertures in the receptacle are registerable with two rows of longitudinally aligned apertures in a laboratory ware magazine stack received within the receptacle.

In an embodiment in which the laboratory ware magazine stack comprises 12 laboratory ware magazines, it is much by preference that the receptacle comprises a row of 12 longitudinally aligned apertures which apertures are registerable with an aperture in each of the laboratory ware magazines within the laboratory ware magazine stack contained within the dispenser. In a more preferred embodiment of the present invention the receptacle comprises two circumferentially spaced rows of apertures.

In a preferred embodiment of the present invention, the laboratory ware dispenser further comprises a lid assembly configured to cover the space provided by the receptacle and to close the first, open end thereof.

More specifically the lid assembly may be configured to engage with the laboratory ware magazine or the laboratory ware stack contained within the receptacle so as to provide for relative rotation of the receptacle and the laboratory ware magazine or the laboratory ware stack.

In one embodiment of the present invention the lid assembly comprises a lid, a rotation facilitation device and a drive means. In this embodiment the rotation facilitation device is configured to engage with the laboratory ware magazine or the laboratory ware stack contained within the receptacle such that there is no relative rotation between the rotation facilitation device and the laboratory ware magazine or the laboratory ware stack. In one embodiment of the third aspect of the present invention, the rotation facilitation device may engage with the magazine retaining means of the laboratory ware magazine. The lid is engageable with the receptacle such that there is no relative rotation between lid and receptacle. The drive means is adapted to be received by the lid and is rotatable relative to the lid and is further engageable with the rotation facilitation device so as to provide relative rotation of the lid/receptacle and the drive means/rotation facilitation device/laboratory ware magazine or the laboratory ware stack.

The rotation facilitation device may be a drive plate. The drive plate is adapted to engage with the laboratory ware magazine adjacent to the lid assembly and is preferably engageable with the laboratory ware magazine by way of coupling with the magazine retaining means on the magazine.

The drive means may be a hand wheel.

The lid assembly may further comprise a gasket seal which may be located between the lid and the receptacle whereby a contamination seal is provided and maintained during use of the laboratory ware dispenser.

The lid may comprise attachment means for engaging the receptacle. The engagement means may be a latching system or alternatively may be a screw and thread arrangement. Any attachment means suitable for maintaining the receptacle and the lid in engagement with one another whilst allowing no relative rotation thereof are suitable for use in the present invention.

The lid assembly may further comprise ejection means to allow the laboratory ware magazine or laboratory ware magazine stack to be ejected from the lid assembly after use.

More specifically the ejection means is located on and/or in the drive means. Even more specifically the ejection means is located in the centre of the drive means.

Suitably the ejection means provides for linear movement of the laboratory ware magazine or laboratory ware magazine stack in a direction perpendicular to the plane of the lid assembly and away from the lid assembly.

The laboratory ware dispenser may further comprise a closure means operable to cover and uncover at least one aperture in the receptacle.

In use, the laboratory ware magazine or stack can be rotated relative to the receptacle so that at least one aperture in the receptacle registers with at least one aperture in the laboratory ware magazine. A user or automated machine can then operate the closure means to uncover the aperture in the receptacle to allow for removal of at least one item of laboratory ware. After removal of the item of laboratory ware the closure means can be operated to cover the aperture again and minimise the risk of contamination of the remaining items of laboratory ware in the laboratory ware dispenser. This operation can be repeated to gain access to successive items of laboratory ware.

The closure means may comprise a closure member which is moveable relative to the receptacle to cover and uncover at least one aperture.

The closure member may be of annular configuration and comprise at least one aperture in a surface thereof the aperture being dimensioned such that at least one but not all of the apertures of the receptacle are registerable with the aperture of the receptacle upon relative rotation of the closure member and the receptacle.

Alternatively, or in addition, the closure member may be of substantially annular configuration having a gap in the circumferential surface thereof. The closure member may have a circumferential dimension sufficient to resist separation from the circumferential surface of the receptacle.

The closure member may further comprise a retaining member configured to resist separation of the closure member from the receptacle of the laboratory ware dispenser. In one preferred embodiment the retaining member is a detent on the closure member. In this embodiment the receptacle comprises an indent or aperture such that in use the detent on the closure member engages with the indent or aperture in the receptacle thereby limiting the extent of annular rotation of the closure member around the circumference of the receptacle. Thus, the retaining member serves as a stop mechanism to limit the movement of the closure member around the receptacle.

The closure member and the receptacle may be configured for releasable coupling by means of a snap-fit arrangement.

In one form, the closure member may be attached to the receptacle for rotation in relation thereto. Thus, for example, the closure member may be rotated clockwise or anti-clockwise to uncover the aperture and the rotational movement reversed to cover the aperture again.

In one embodiment the closure member may be an open C-shaped cover, moveable around the circumferential surface of the receptacle to cover and uncover at least one aperture in the receptacle. In this arrangement, the C-shaped cover may cover the full longitudinal width of the receptacle over part of the circumferential surface or, alternatively, a plurality of moveable C-shaped covers may be provided each cover operable to cover and uncover at least one but not all of the apertures in the receptacle. In a more preferable embodiment of the invention, the number of C-shaped covers will be equal to the number of apertures in one longitudinal row in the receptacle. For example, if the receptacle comprises 12 longitudinally aligned apertures, the laboratory ware dispenser will comprise 12 C-shaped covers with each cover operable to cover and uncover one aperture. The C-shaped covers may be operable independently of the other C-shaped covers, or alternatively may be operable in co-operation with each other.

The laboratory ware dispenser may further comprise a stand by which the dispenser may be placed on a planar surface, a work area for example. The stand is located on the dispenser so as not to impair access to the items of laboratory ware dispenser therein.

The stand may be integral with the receptacle or, alternatively, by be separate from the receptacle. In the latter arrangement the stand may be attached to the receptacle by a snap-fit arrangement, for example.

The laboratory ware magazine or laboratory ware magazine stack receivable by the receptacle may further comprise a detent configured to provide radial positioning of the laboratory ware magazine or laboratory ware magazine stack within the receptacle.

The detent may provide an audible feedback to a user of the receptacle to indicate registration of an aperture of the receptacle with an aperture of a laboratory ware magazine or laboratory ware magazine stack within the receptacle. The audible feedback may, for example, indicate the registration of the next longitudinal row of apertures of the laboratory ware magazine stack with the row of apertures in the receptacle.

In accordance with a fourth aspect of the present invention there is provided a laboratory ware dispenser comprising:

a receptacle defining a space for containing a plurality of items of laboratory ware;

a lid for covering the space, the lid having an aperture and a user operable closure means for covering and uncovering the aperture;

the lid being configured to engage with the receptacle when covering the space so as to provide for relative rotation of lid and receptacle; and the aperture being dimensioned such that at least one but not all of the items of laboratory ware contained in the space is brought into registration with the aperture upon relative rotation of the lid and receptacle, thereby allowing for selective removal of the at least one item of laboratory ware from the space.

In use, the lid can be rotated so that the aperture registers with a desired batch of items of laboratory ware. The user can then operate the closure means to uncover the aperture to allow for removal of the batch of items. After removal of the items the closure means can be operated to cover the aperture again and minimise the risk of contamination of the items remaining in the dispenser. This operation can be repeated for successive batches of items, with the rotational movement of lid and receptacle to gain access to successive batches of items providing for single handed operation. A further advantage is that a laboratory ware dispenser according to the invention can provide for a reduction in the space required for its use compared with a conventional rectangular sliding lid dispenser. This is because when the rectangular sliding lid dispenser is fully open it takes up twice the space taken up when fully closed.

More specifically, the closure means may comprise a closure member which is moveable across the lid to cover and uncover the aperture. For example, the closure member of the closure means may be slidable over the lid.

In one form, the closure member may be attached to the lid for rotation in relation thereto. Thus, for example, the closure member may be rotated clockwise or anti-clockwise to uncover the aperture and the rotational movement reversed to cover the aperture again.

More specifically, the closure member may be substantially circular in shape and configured for rotation about an axis located towards an outer edge of the closure member.

Alternatively, the shape of the closure member may be defined by a straight edge and a curved edge such that the closure member is of a substantially semi-circular shape, the closure member being configured for rotation about an axis located towards its straight edge and half-way along the straight edge.

Alternatively or in addition, the aperture may be substantially circular or substantially triangular in shape.

Embodiments of the invention according to the immediately preceding three paragraphs are suited to use with microtubes which tend to require a larger aperture than, for example, pipette tips.

In another form, the closure member may be secured to the lid for linear displacement in relation thereto. Thus the closure member may be moved linearly to and fro across the lid to cover and uncover the aperture.

More specifically, the closure member may be secured to the lid by means of a snap-fit arrangement.

Alternatively or in addition, the closure means may further comprise a retaining member configured to resist separation of the closure member from the lid.

More specifically, the retaining member may define with the lid a retaining aperture through which a part of the closure member passes as it moves across the lid.

Embodiments of the invention according to the immediately preceding five paragraphs are suited to use with pipette tips which tend to require a smaller aperture than, for example, microtubes.

The receptacle may define a substantially cylindrical space, and the lid may be of substantially circular footprint and of such a size to cover the cylindrical space.

More specifically, the lid may comprise an annular body having a screw threaded portion, which can engage with a corresponding screw threaded portion on the receptacle, and a circular body in which the aperture is formed, the circular body being configured to releasably couple with the annular body and to rotate in relation to the annular body when engaged therewith.

More specifically, the circular body and the annular body may be configured for releasable coupling by means of a snap-fit arrangement.

The lid may comprise one or more elements extending from its upper surface and configured to provide for finger-tip rotation of the lid in relation to the receptacle.

The closure means may comprise one or more portions extending from its surface and configured to provide for finger-tip movement of the closure means in relation to the aperture.

The aperture may be one of substantially circular, substantially triangular and substantially rectangular in shape.

The laboratory ware dispenser may further comprise a support member receivable within the space of the receptacle, the support member being configured to support a plurality of items of laboratory ware.

More specifically, the support member and the receptacle may be configured to resist rotation of the support member in relation to the receptacle when the support member is received in the space. Thus, there is less risk of items of laboratory ware supported in the support member rotating with the lid when the lid is rotated in relation to the receptacle.

More specifically, the support member and the receptacle may comprise at least one pair of interlocking parts.

More specifically, the support member may comprise at least one tooth projecting from its outer edge and the surface of the receptacle defining the space may have at least one groove for receiving a corresponding tooth. The groove may extend from an open end of the receptacle into the space. Thus, for example, the support member may be positioned over the receptacle such that its teeth align with the corresponding grooves in the receptacle and the support member lowered into the space such the teeth are received in the grooves. Hence rotation of the support member within the receptacle space may be inhibited.

Alternatively or in addition, the support member may be configured to support a plurality of differently sized items of laboratory ware.

More specifically, the support member may comprise a plurality of apertures, each aperture being for receiving an item of laboratory ware.

Alternatively or in addition, the support member may be configured such that when it is one way up it supports a plurality of items of a first size and when turned upside down it supports a plurality of items of a second size.

More specifically, the support member may be configured such that it supports a plurality of items each having a tapering body (e.g. pipette tips or microtubes) of a first maximum diameter and when turned upside down it supports a plurality of items each having a tapering body of a second, larger maximum diameter.

More specifically, the support member may define a plurality of bores extending through the support member, each bore being of non-uniform diameter along its length for receiving an item of laboratory ware.

More specifically, each bore may define a rim extending radially into the bore and located towards one end of the bore. Thus, the rim may restrict the diameter of the bore towards one end of the bore.

The support member may be configured to accommodate a plurality of different sizes of pipette tips, such as yellow tips, which are typically of 8 to 9 mm diameter, and blue tips, which are typically of 9 to 10 mm diameter and having a fluid volume typically in the ranges of 1-200 μl and 101-1000 μl respectively.

The laboratory ware magazine, laboratory ware magazine stack and/or laboratory ware dispensers of the present invention may be formed in part or in whole of a material suitable for autoclaving and/or for gamma radiation sterilisation.

More specifically, the laboratory ware magazine, laboratory ware magazine stack and/or laboratory ware dispensers may be formed in part or in whole of mouldable plastic material.

More specifically, the laboratory ware magazine, laboratory ware magazine stack and/or laboratory ware dispensers may be formed in part or in whole of one or both of polypropylene and polycarbonate.

The support member, laboratory ware magazine and/or laboratory ware magazine stack may be configured for removal from the receptacle. Thus, the dispenser can be readily refilled with another support member, laboratory ware magazine or laboratory ware magazine stack having a full complement of items of laboratory ware.

The present inventor has realised that the support member may be of wider application than hitherto described. Thus, according to a fifth aspect of the present invention there is provided a laboratory ware support member for supporting a plurality of items of laboratory ware, the support member being configured to be removably received within a laboratory ware dispenser and comprising a plurality of apertures, each aperture being for receiving an item of laboratory ware, in which the support member is configured such that when it is one way up it supports a plurality of items of laboratory ware of a first size and when turned upside down it supports a plurality of items of laboratory ware of a second size.

More specifically, the support member may be configured such that it supports a plurality of items of laboratory ware each having a tapering body (e.g. pipette tips or microtubes) of a first maximum diameter and when turned upside down it supports a plurality of items each having a tapering body of a second, larger maximum diameter.

More specifically, the support member may define a plurality of bores extending through the support member, each bore being of non-uniform diameter along its length for receiving an item of laboratory ware.

More specifically, each bore may define a rim extending radially into the bore and located towards one end of the bore. Thus, the rim may restrict the diameter of the bore towards one end of the bore.

The support member may be configured to accommodate a plurality of different sizes of pipette tips, such as yellow tips, which are typically of 8 to 9 mm diameter, and blue tips, which are typically of 9 to 10 mm diameter and having a fluid volume typically in the ranges of 1-200 μl and 101-1000 μl respectively.

Embodiments of the fifth aspect of the present invention may comprise one or more features according to the fourth aspect of the invention.

According to a sixth aspect of the present invention there is provided a laboratory ware support member for supporting a plurality of items of laboratory ware in a laboratory ware dispenser, the support member being of substantially circular footprint and configured to be removably received within a substantially cylindrical space defined by the laboratory ware dispenser, in which the support member and the laboratory ware dispenser are configured to resist rotation of the support member in relation to the laboratory ware dispenser when the support member is received in the space.

More specifically, the support member and the laboratory ware dispenser may comprise at least one pair of interlocking parts.

More specifically, the support member may comprise at least one tooth projecting from its outer edge and the surface of the laboratory ware dispenser defining the cylindrical space may have at least one groove for receiving a corresponding tooth. The groove may extend from an open end of the laboratory ware dispenser into the space. Thus, for example, the support member may be positioned over the laboratory ware dispenser such that its teeth align with the corresponding grooves in the laboratory ware dispenser and the support member lowered into the space such the teeth are received in the grooves. Hence rotation of the support member within the laboratory ware dispenser may be inhibited.

Embodiments of the sixth aspect of the present invention may comprise one or more features according to the fourth or fifth aspect of the invention.

The removability of the support member from the laboratory ware dispenser provides for ease of replenishment of the dispenser with fresh items of laboratory ware. Thus, according to a seventh aspect of the present invention there is provided a laboratory ware dispenser comprising an elongate body defining a substantially cylindrical space configured to receive and hold in spaced apart relation along the cylindrical space a plurality of support members of substantially circular footprint, each support member being configured to support a plurality of items of laboratory ware, and the dispenser being configured to release a support member from the cylindrical space upon user actuation.

More specifically, the cylindrical space may have an opening at one end configured to provide for release of support members.

Alternatively or in addition, the plurality of support members may be stacked on top of each other such that one support member bears the weight of another. Thus, when a support member is released from the dispenser the next support member may move to a location in readiness for its release from the dispenser.

Alternatively or in addition, the laboratory ware dispenser may further comprise user operable support member holding means, which in a first operating condition holds a support member in position and in a second operating condition permits release of the support member from the dispenser.

More specifically, the support member holding means may be configured to remain in or return to the first operating condition in the absence of user operation.

More specifically, the support member holding means may comprise biasing means to keep the holding means in or return the holding means to the first operating condition.

Alternatively or in addition, the support member holding means comprises a body extending from the exterior of the dispenser into the cylindrical space, a first end of the body in the space being configured to engage with a support member and a second end of the body on the exterior being configured for user operation to disengage the first end of the body from the support member.

The laboratory ware dispenser may be formed in part or in whole of a material suitable for autoclaving.

More specifically, the laboratory ware dispenser may be formed in part or in whole of one or both of polypropylene and polycarbonate.

Embodiments of this aspect of the present invention may comprise one or more features according to any one or more of the other aspects of the invention.

Specific embodiments of the present invention will now be described by way of example only and with reference to the drawings, in which.

Figure 1:
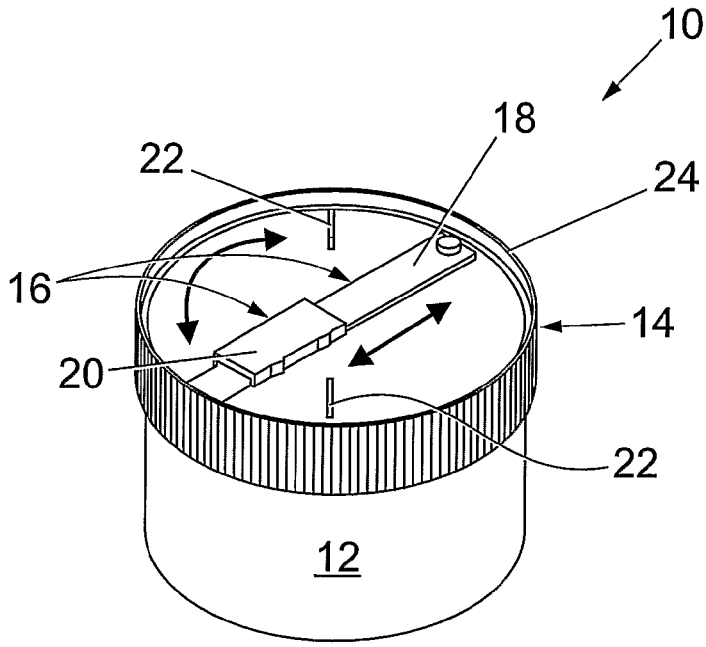
FIG. 1 shows a laboratory ware dispenser according to the invention.
Figure 2:
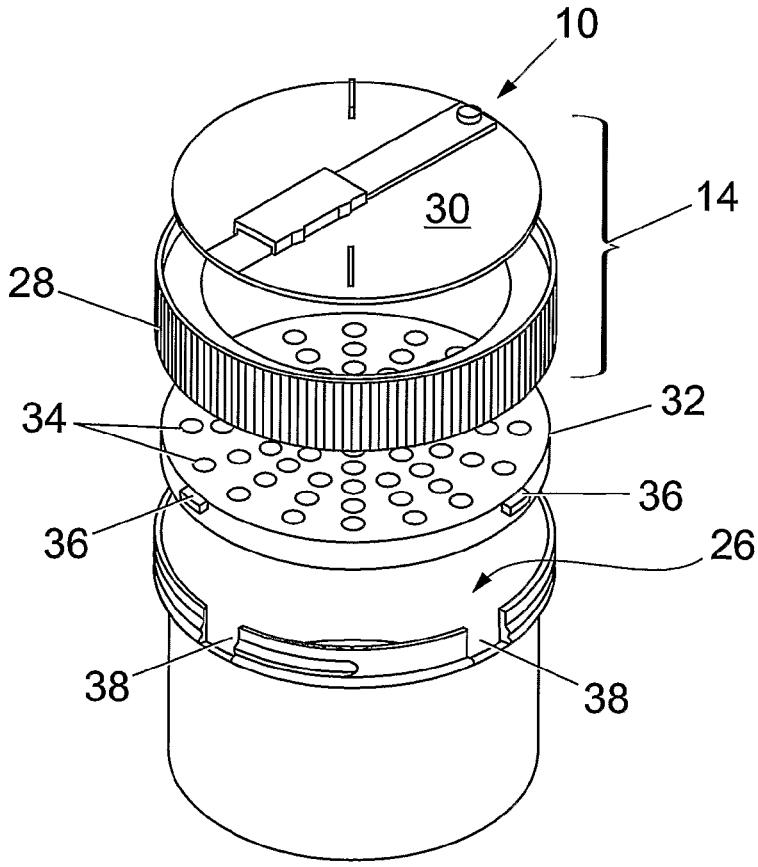
FIG. 2 is an exploded view of the dispenser of FIG. 1.
Figure 3:
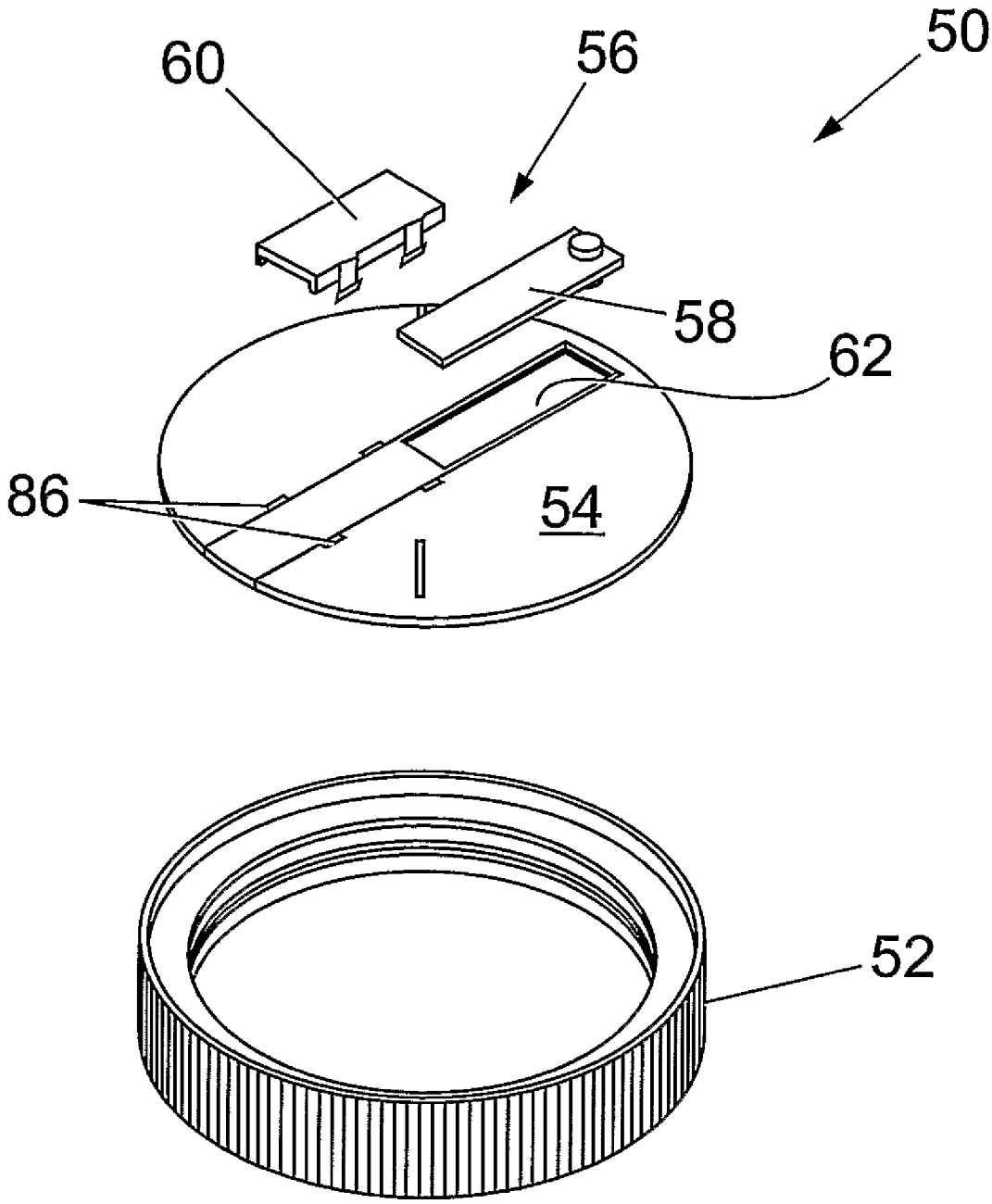
Figure 4:
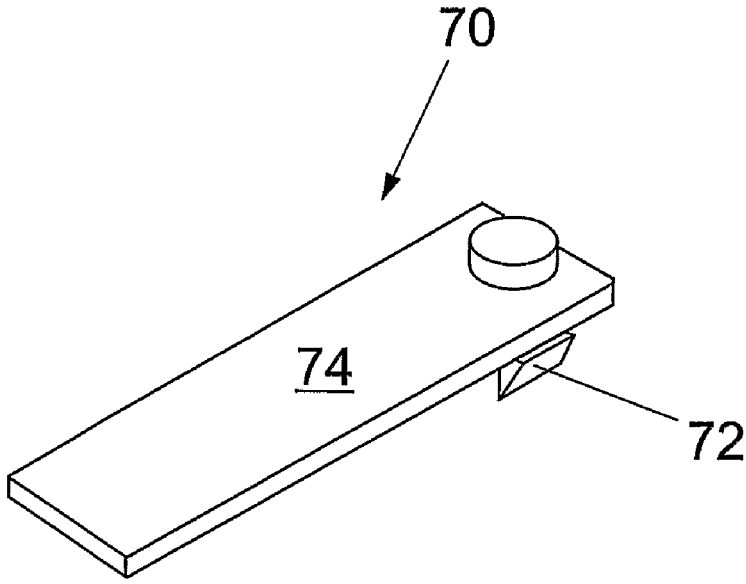
Figure 5:
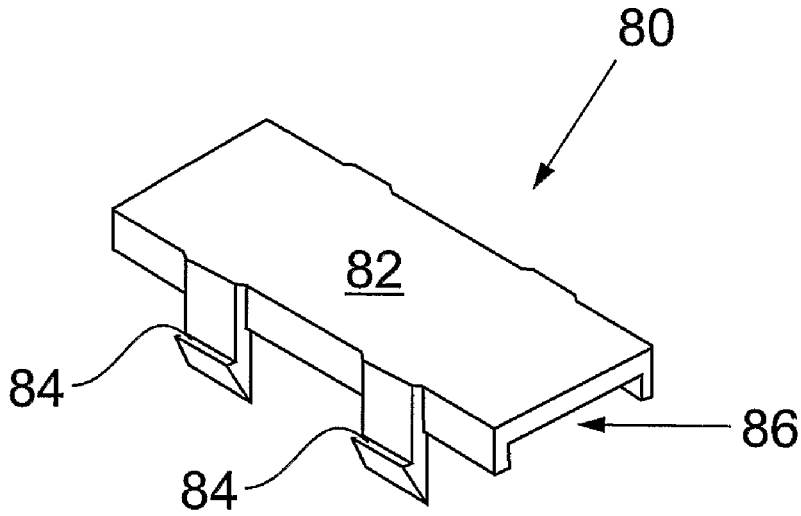
Figure 6:
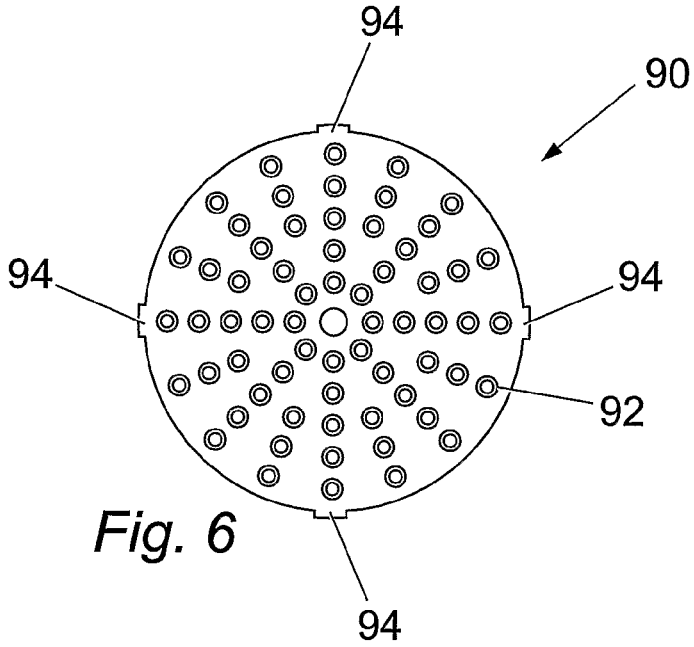
Figure 7:
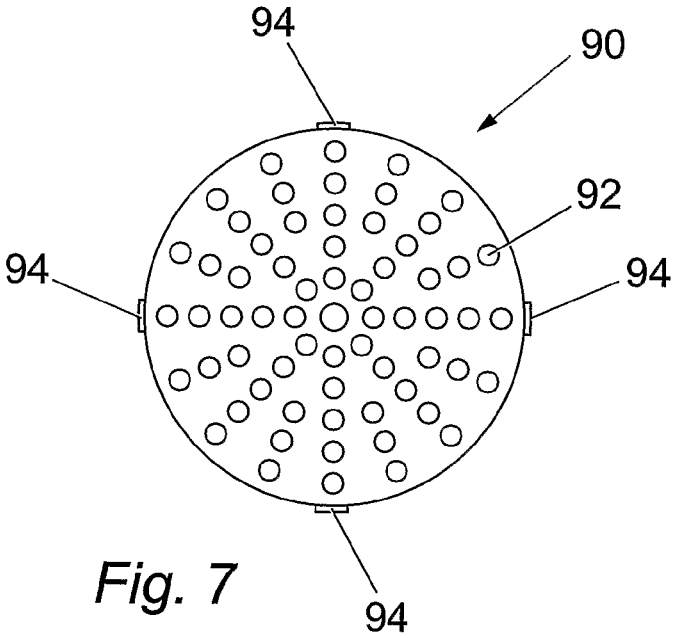
Figure 8:
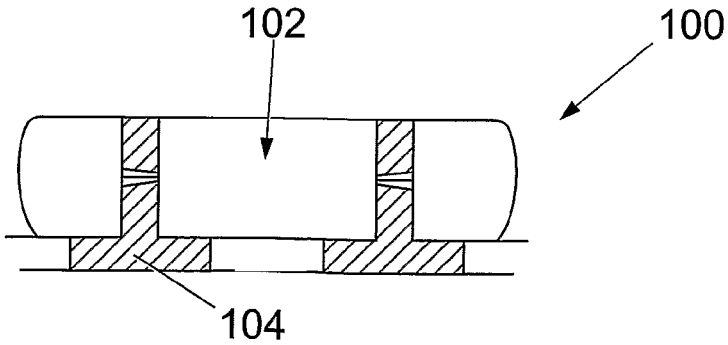
Figure 11:
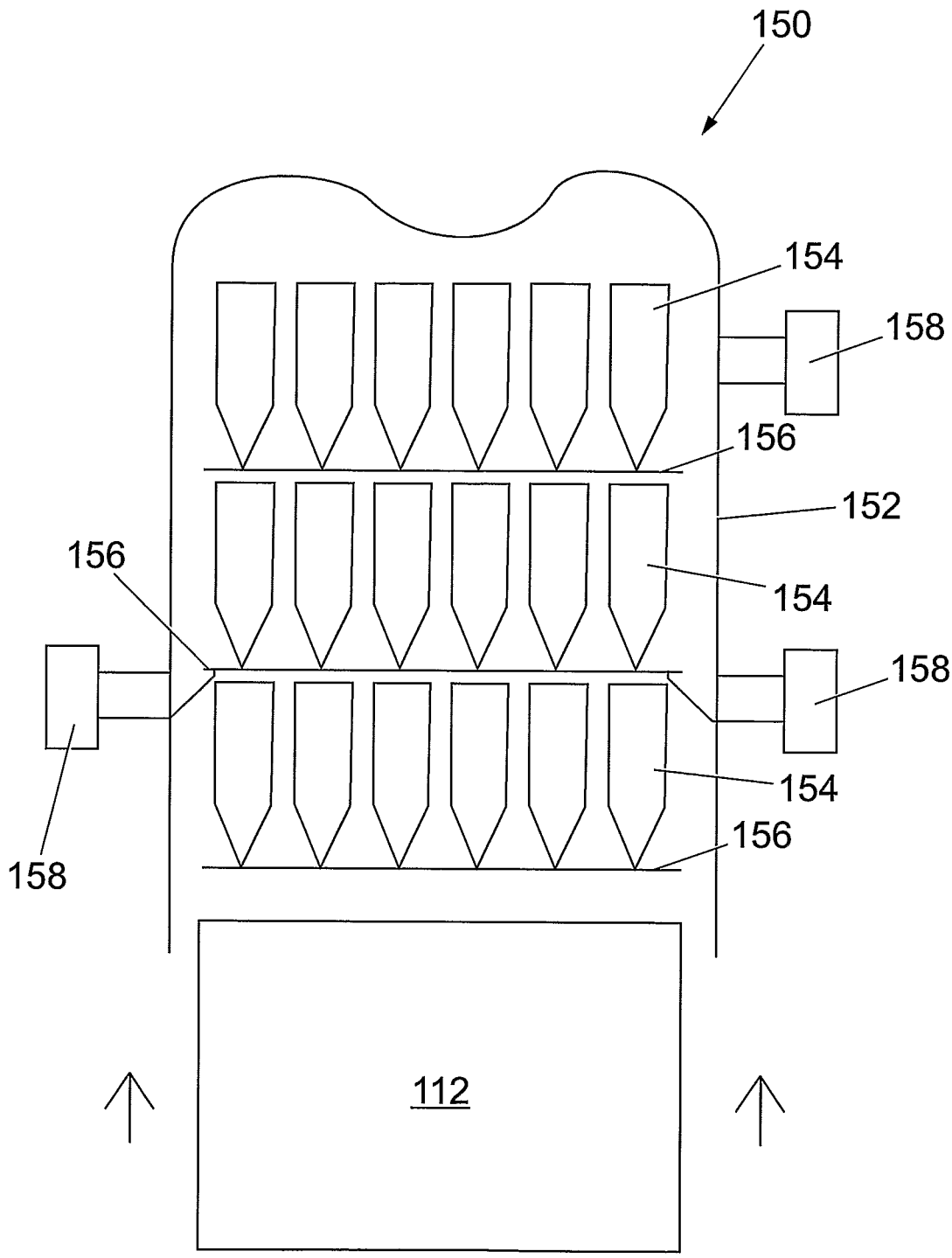
Figure 12:
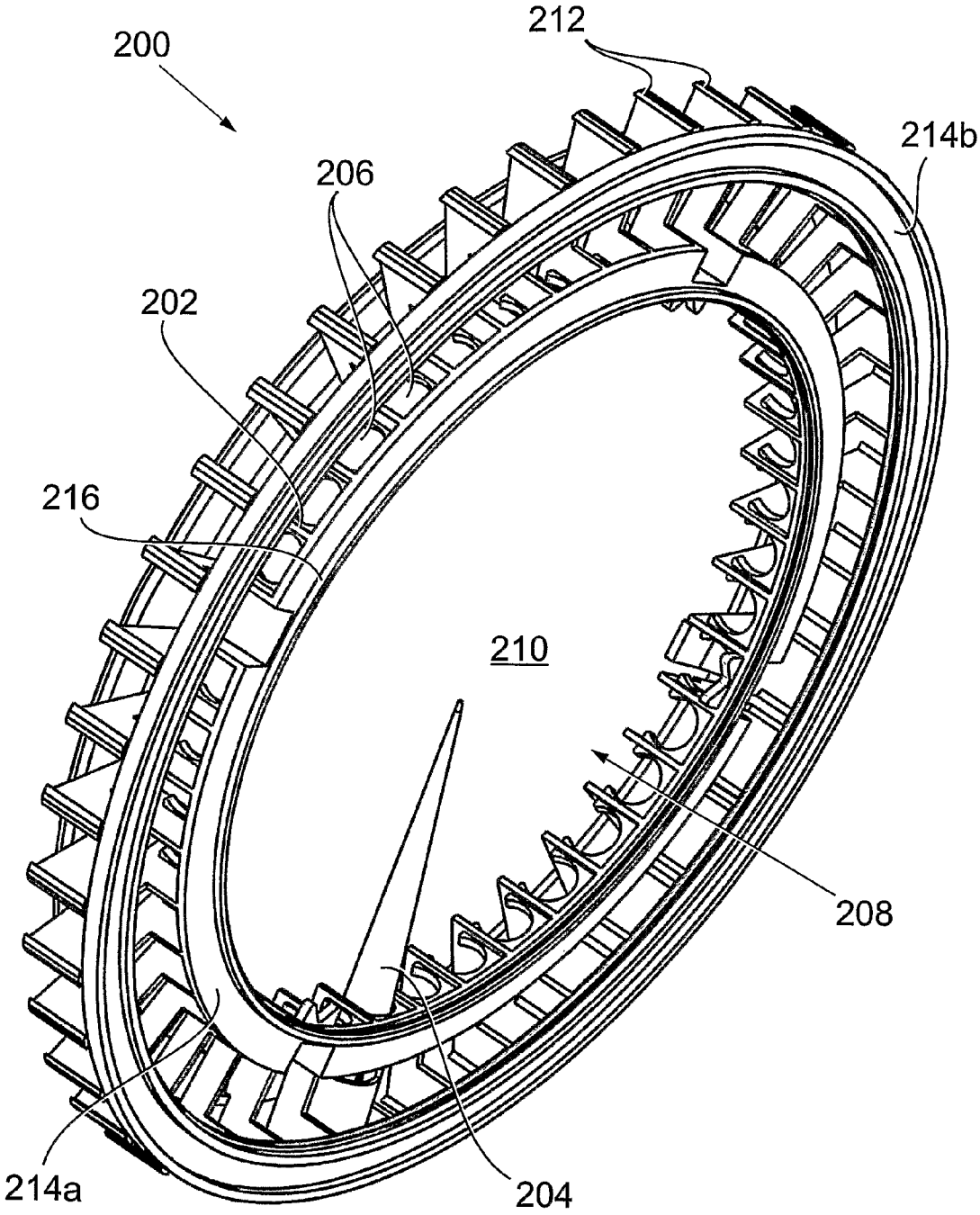
Figure 13:
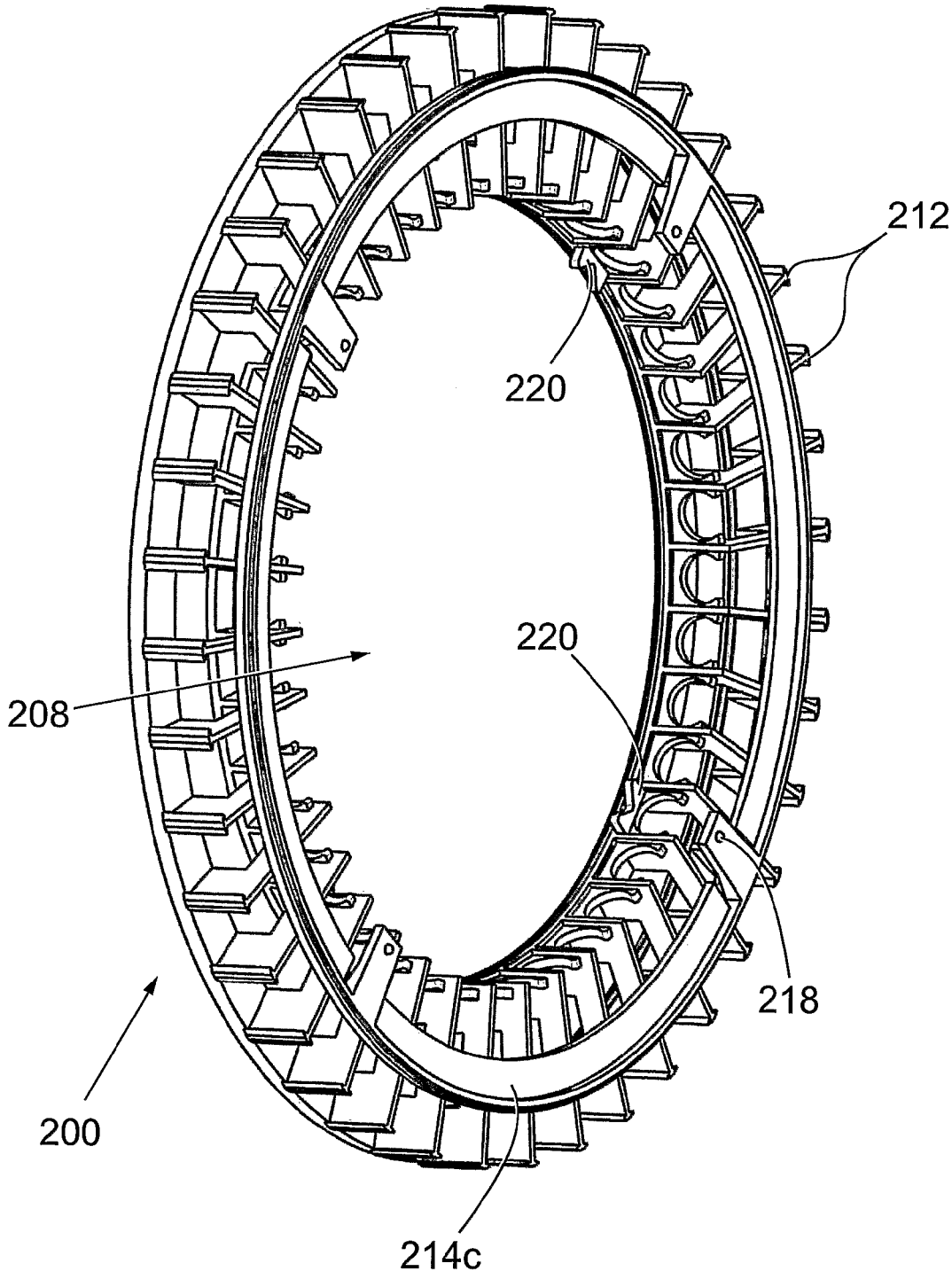
Figure 14:
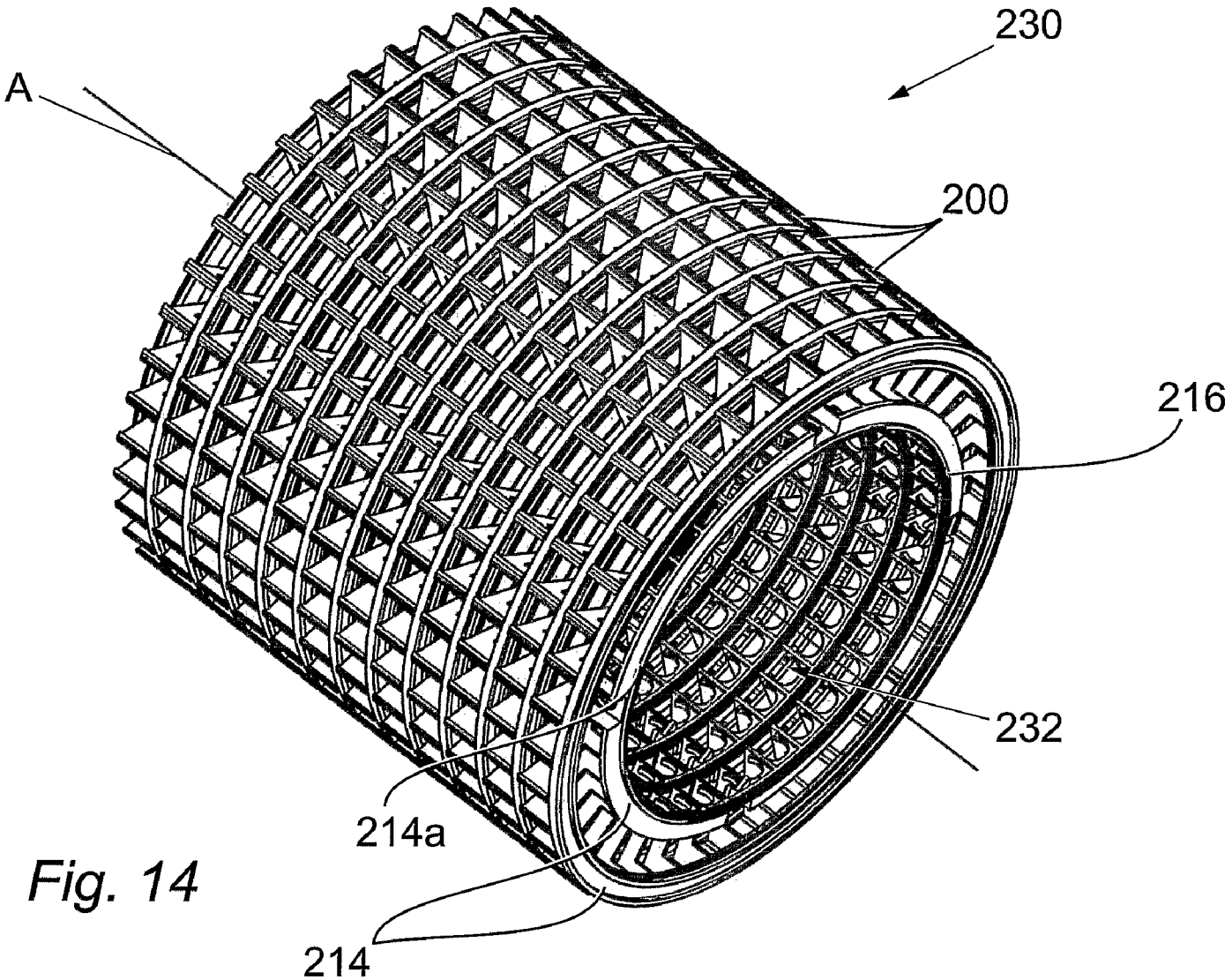
Figure 15:
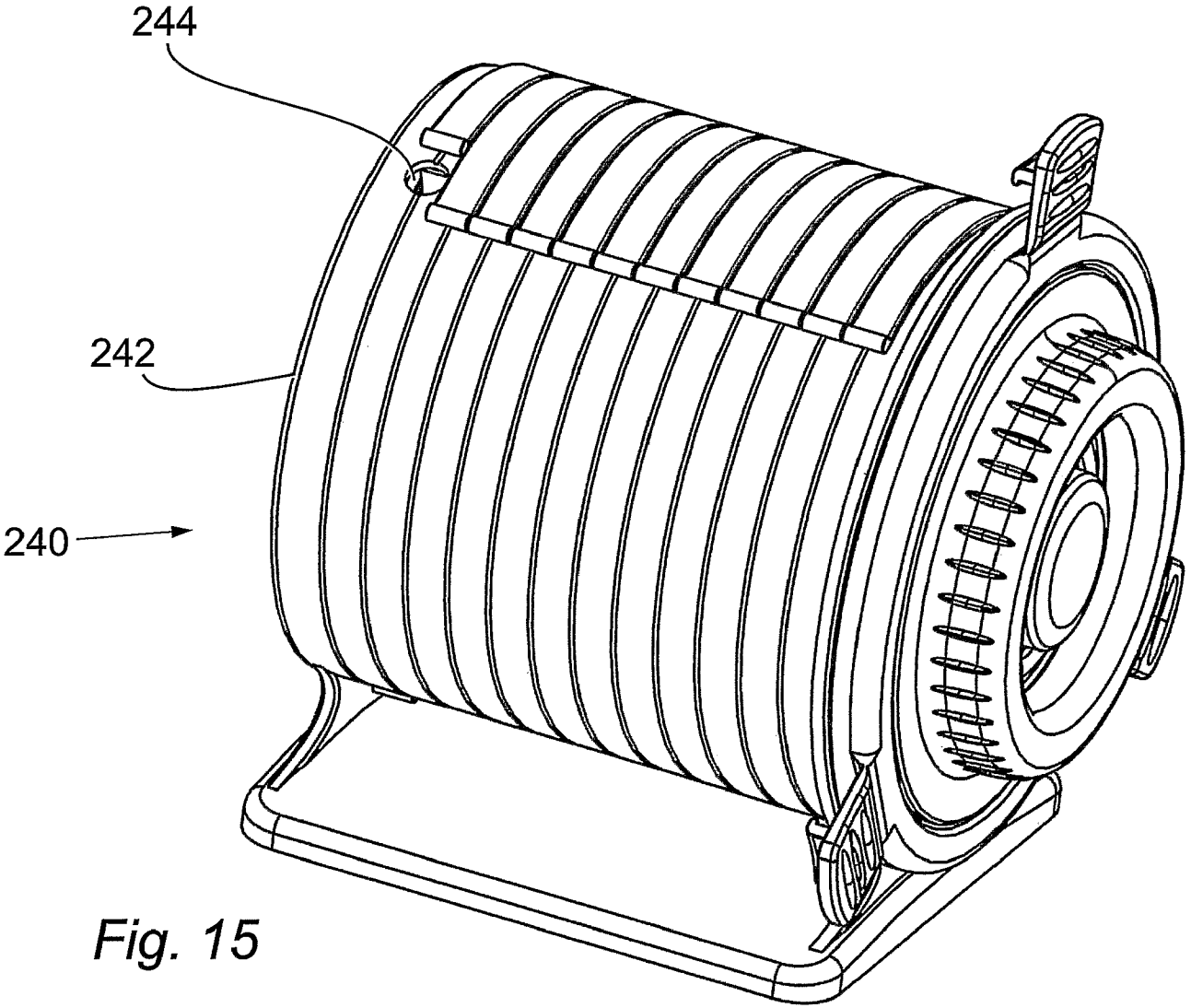
Figures 16A, 16B, 16C:
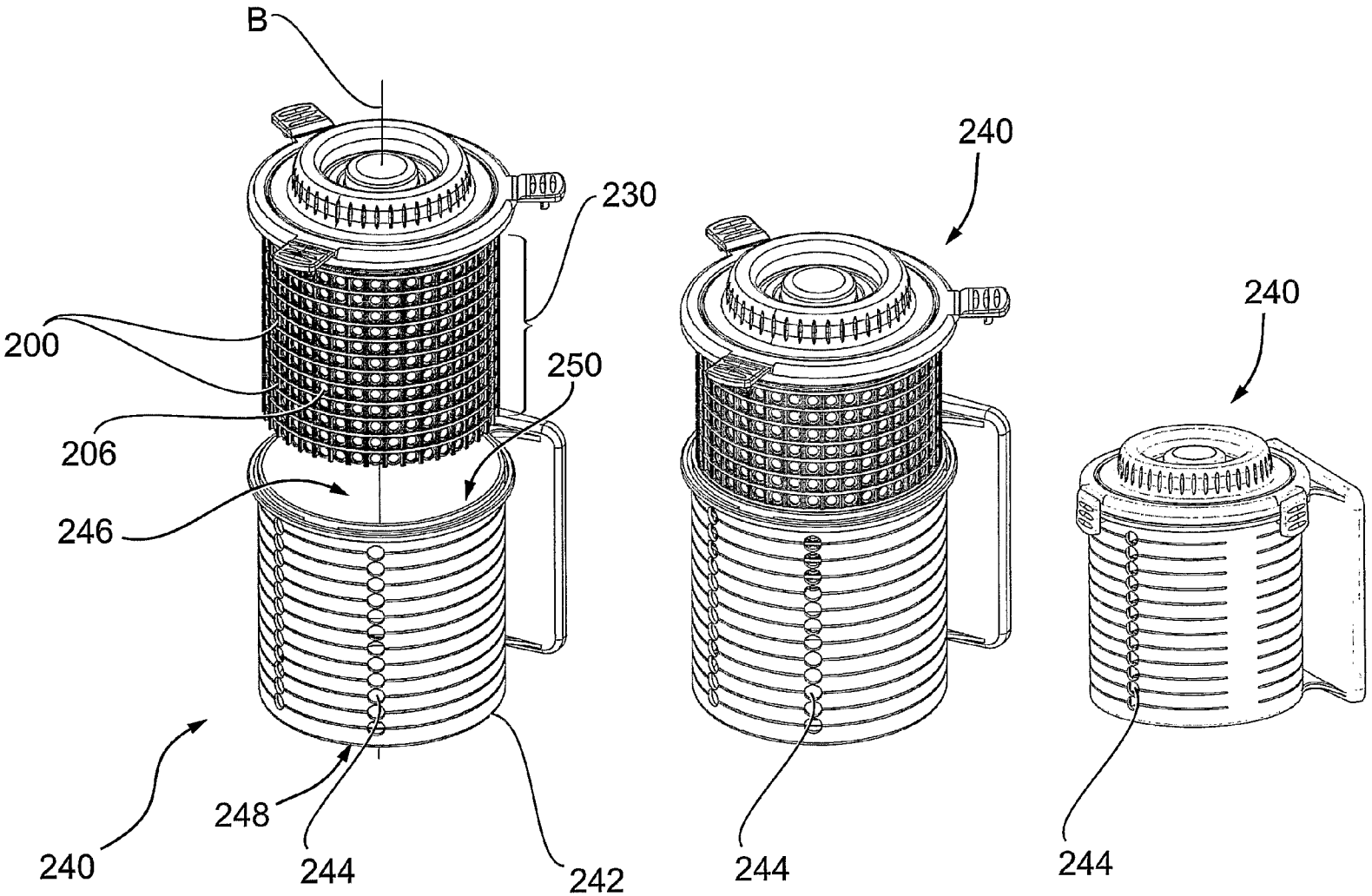
Figure 17:
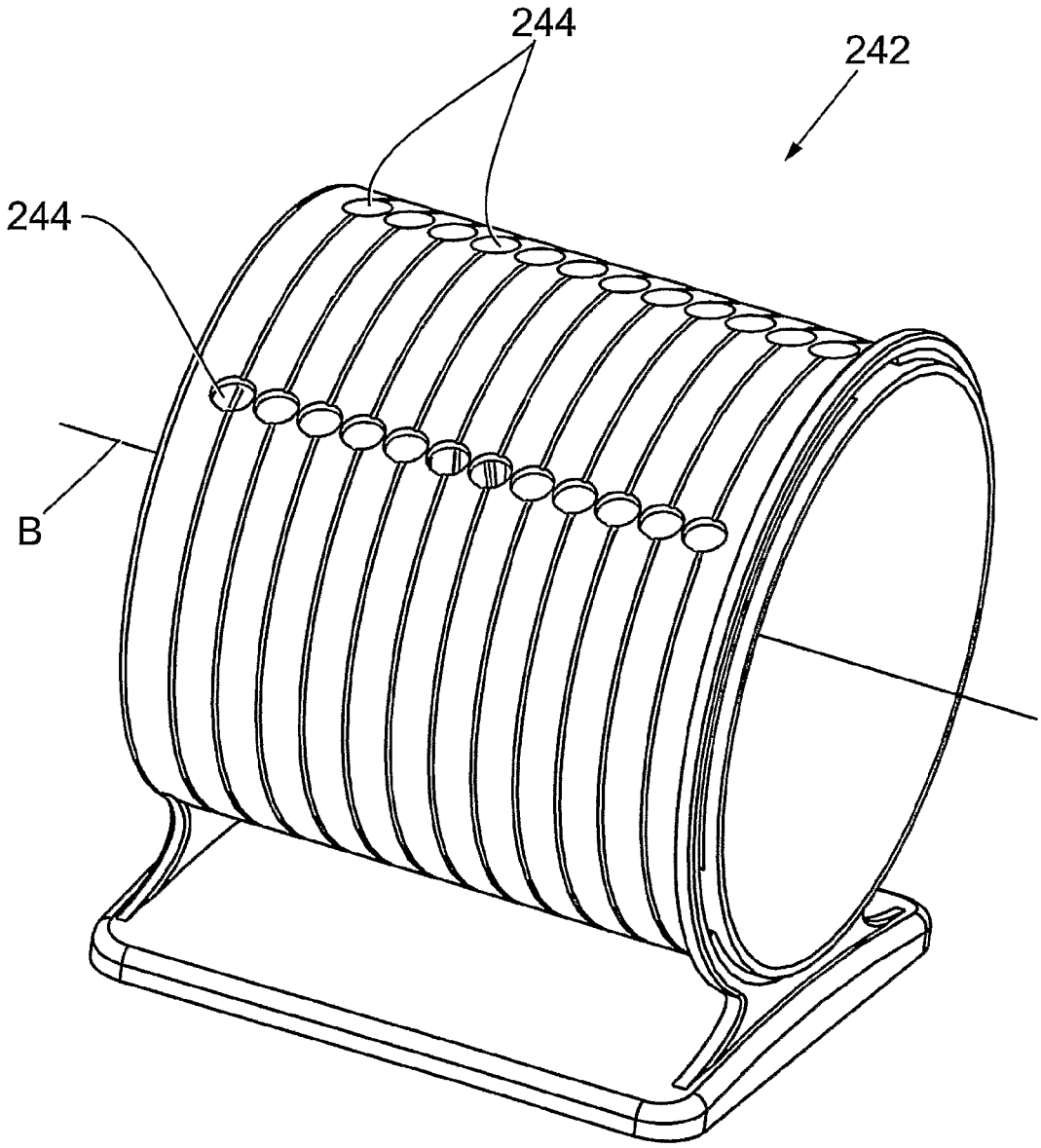
Figure 18A:
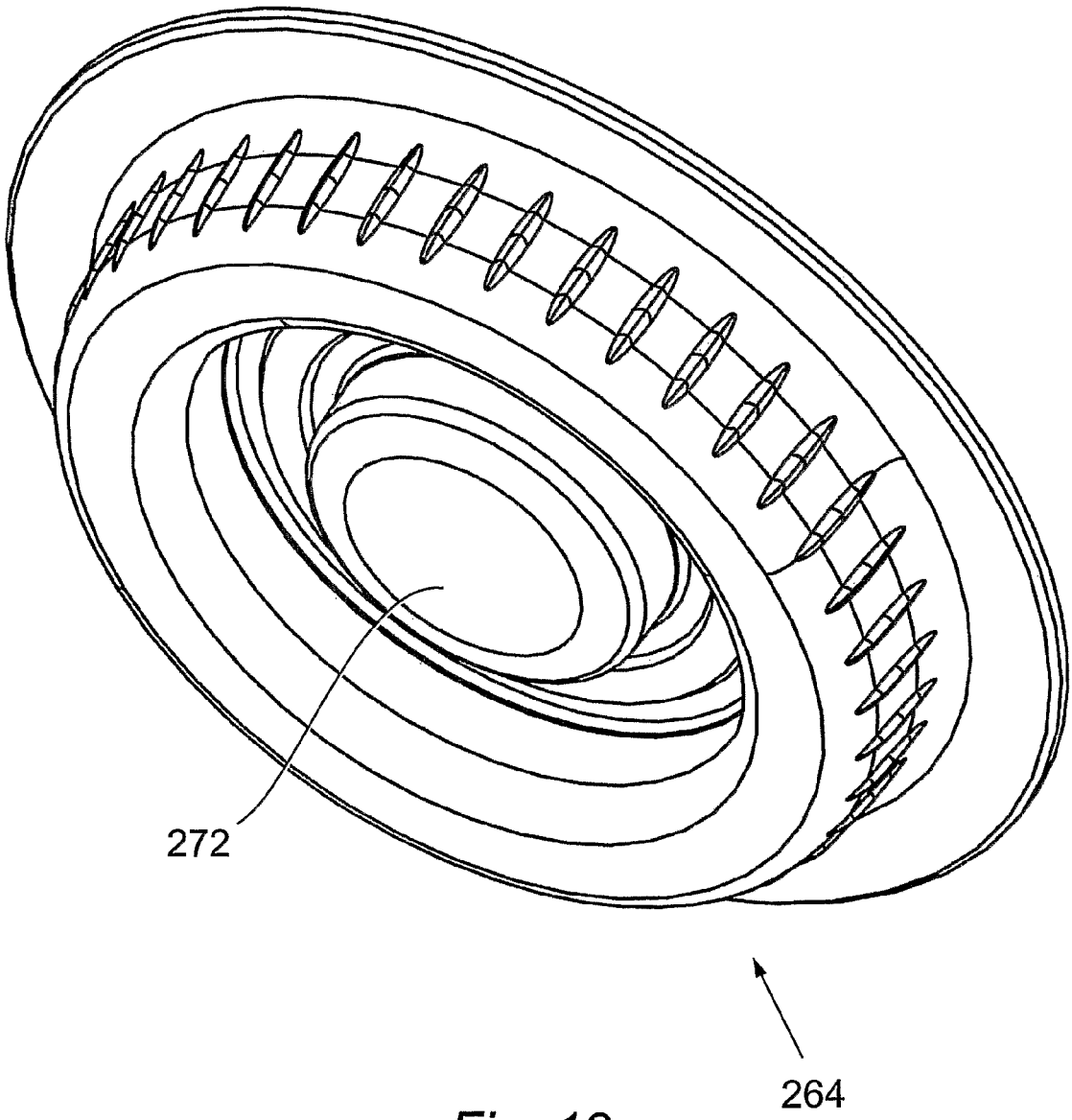
Figure 18B:
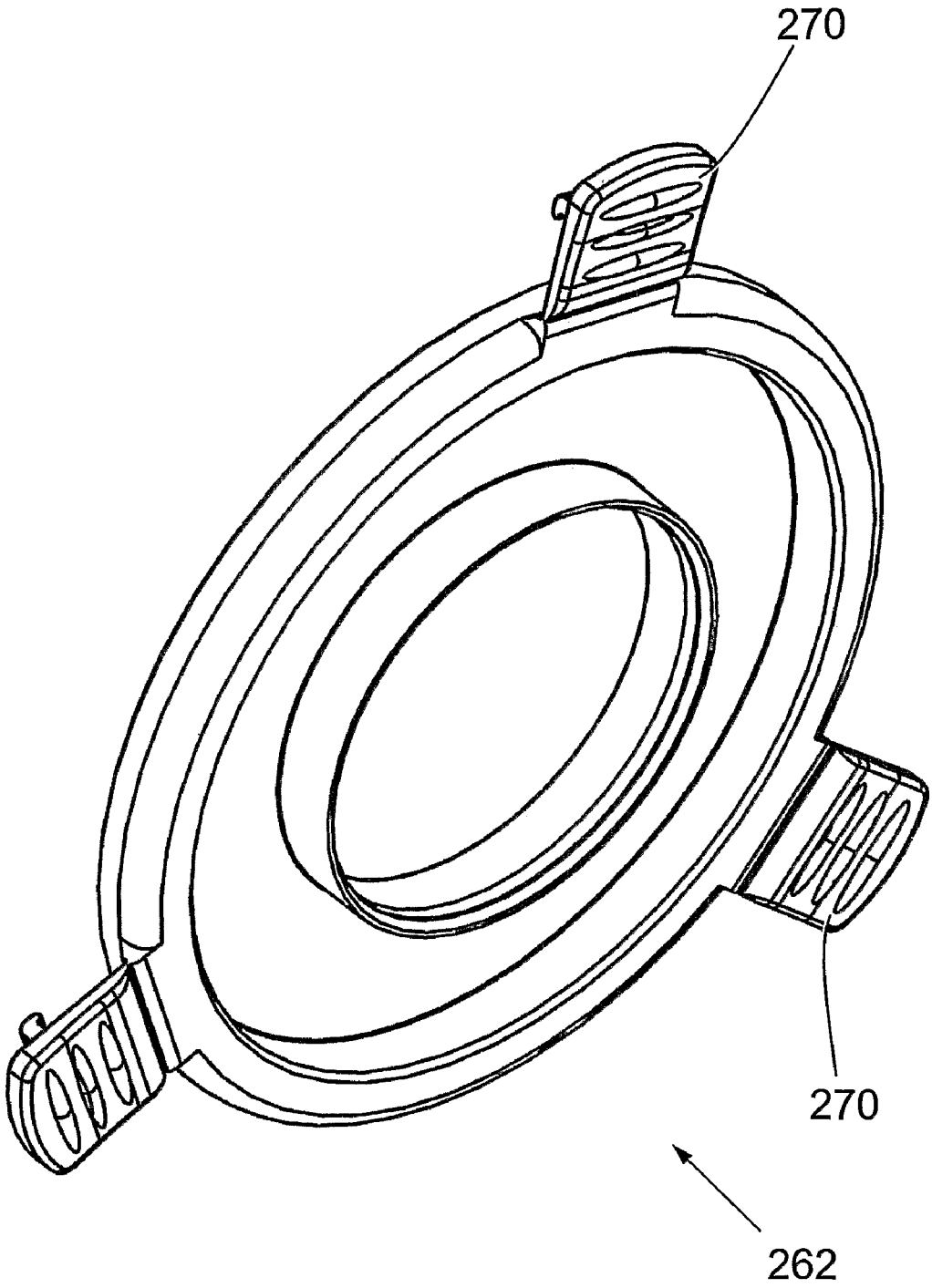
Figure 18C:
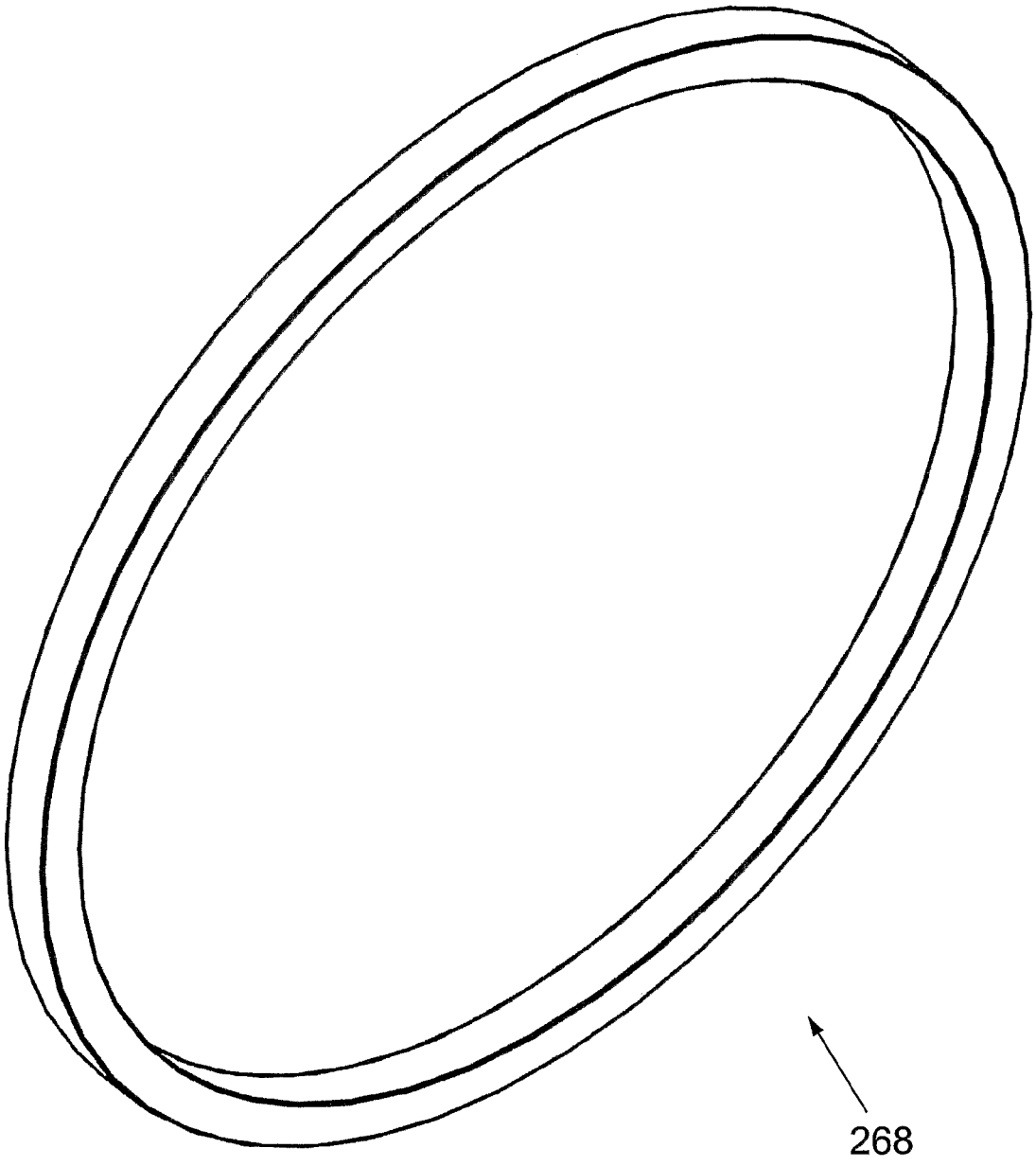
Figure 18D:
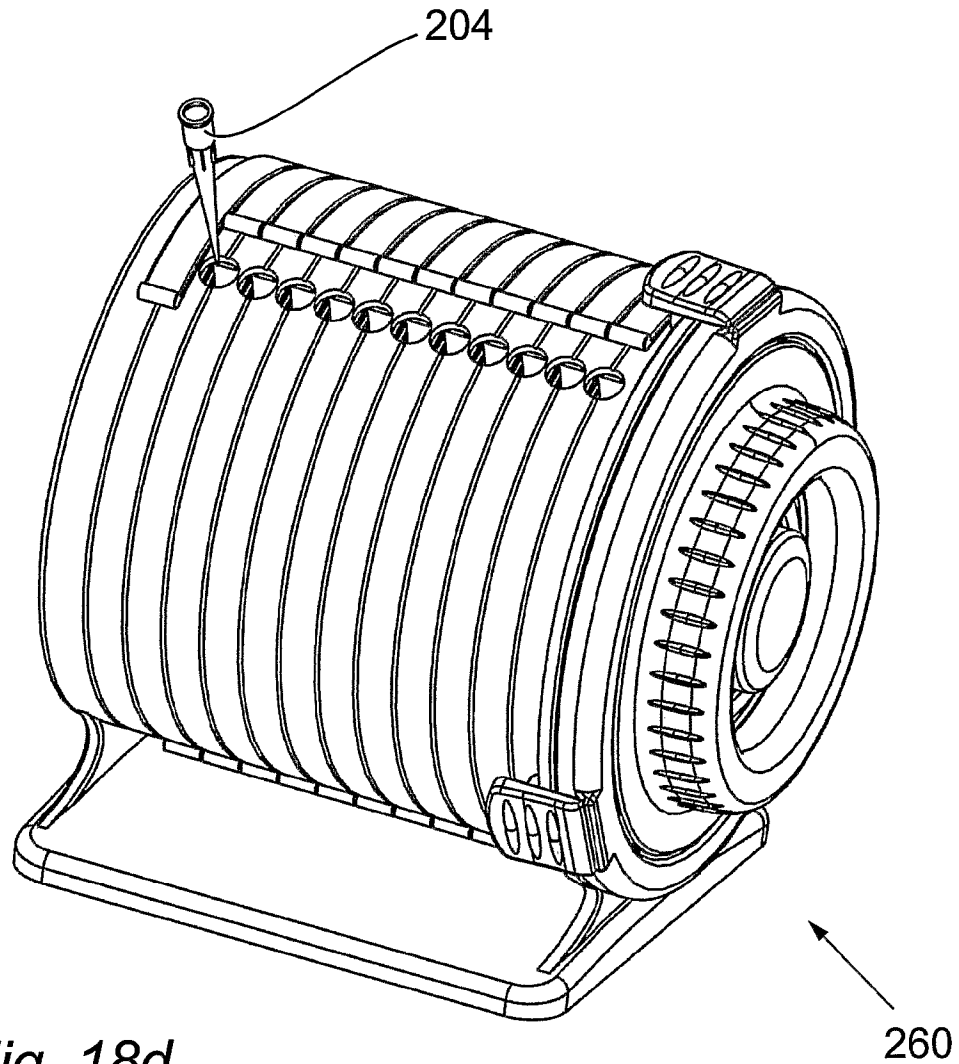
Figure 19:
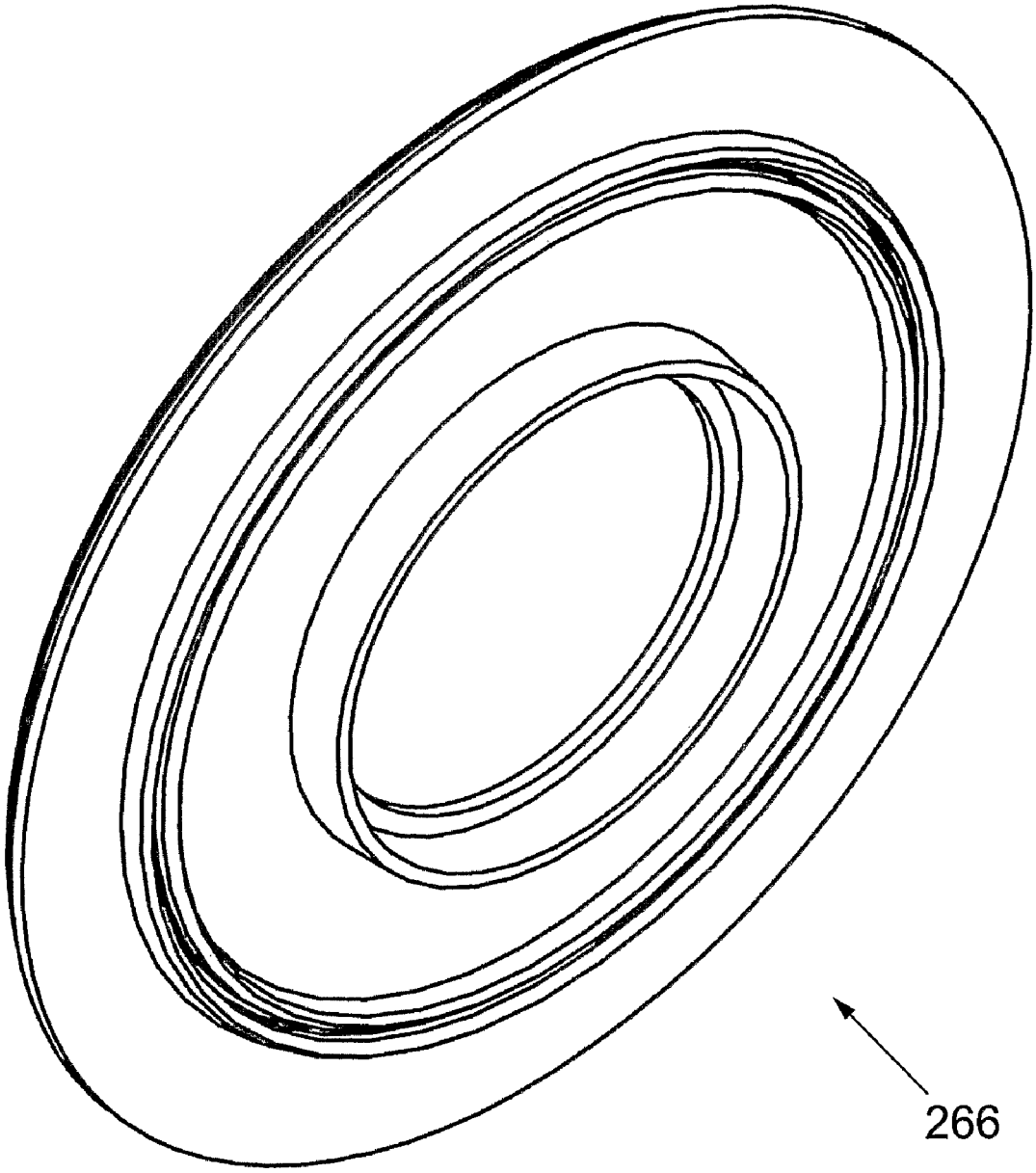
Figure 20:
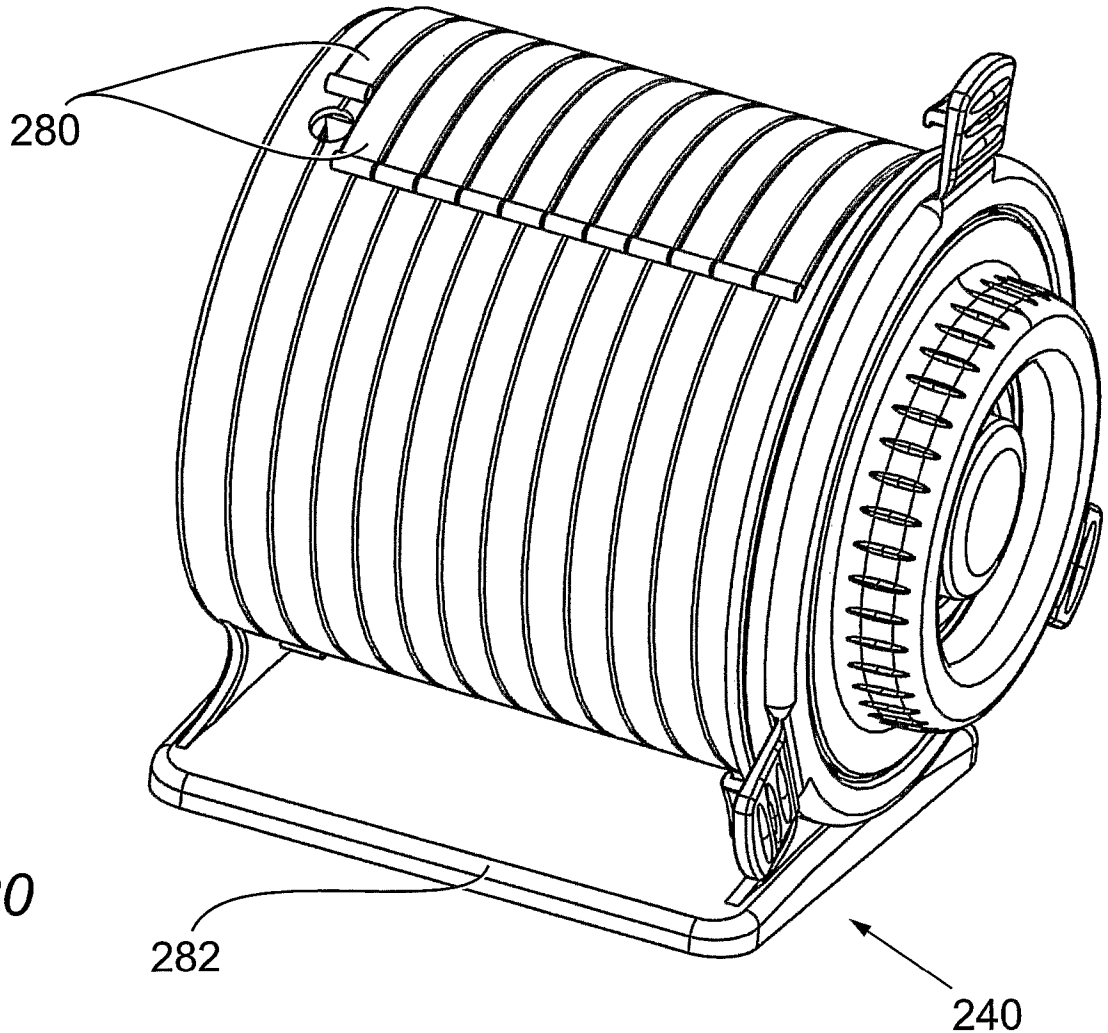
Figure 21:
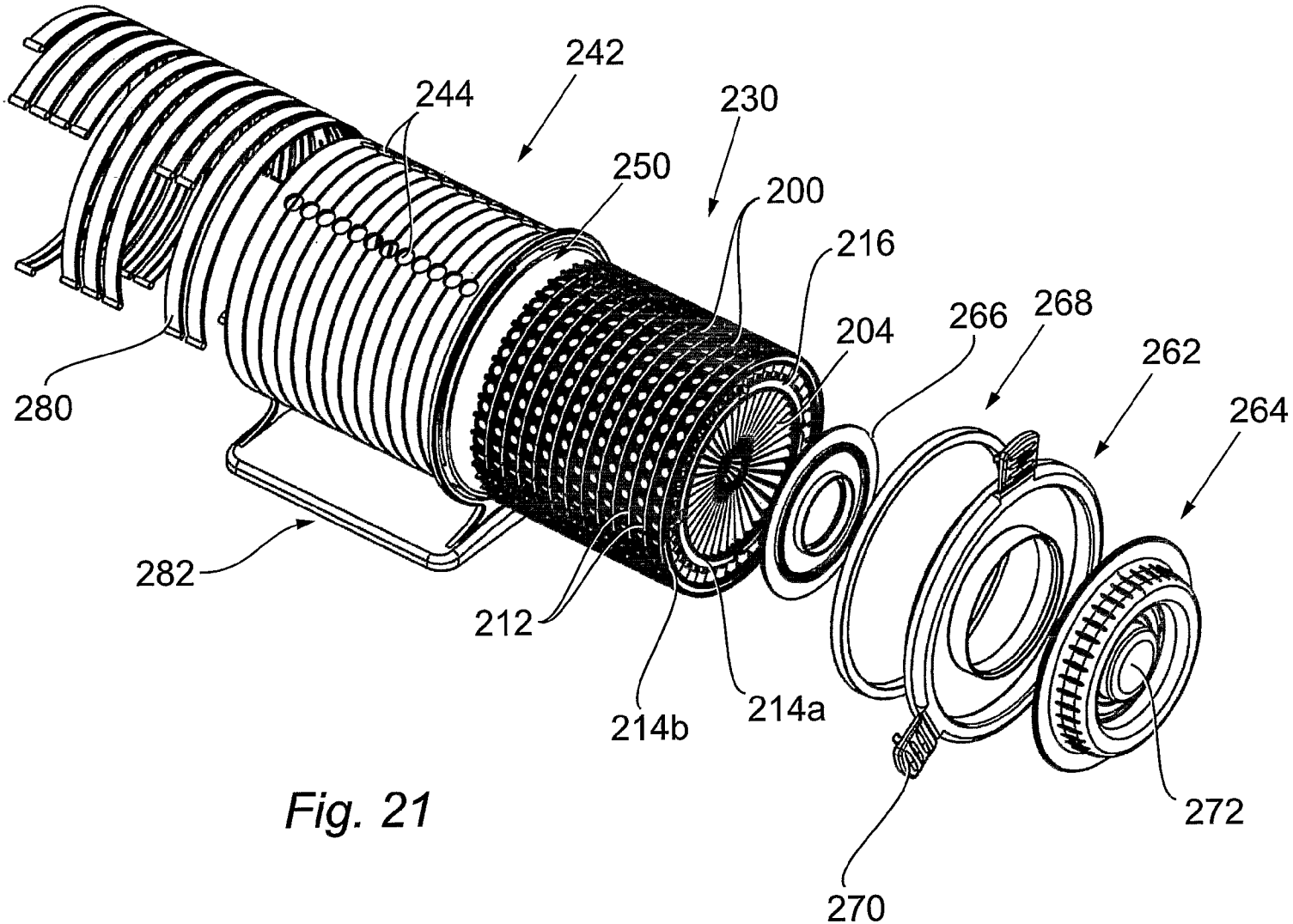

FIG. 3 is an exploded view of the lid of the dispenser of FIGS. 1 and 2, FIG. 4 is a detailed view of the closure member of the lid shown in FIG. 3, FIG. 5 is a detailed view of the retaining member of the lid shown in FIG. 3, FIG. 6 is a detailed view from above of the support member shown in FIG. 2, FIG. 7 is a detailed view from below of the support member shown in FIG. 2, FIG. 8 is a cross-sectional view of the support member shown in FIG. 2, FIG. 9 is a view from above of an alternative embodiment of a laboratory ware dispenser according to the invention, FIG. 10 is a vertical cross-section through the dispenser of FIG. 9, FIG. 11 is a laboratory ware dispenser according to the invention, FIG. 12 is a laboratory ware magazine according to the invention, FIG. 13 is a reverse perspective view of the laboratory ware magazine according to FIG. 12, FIG. 14 is a laboratory ware magazine stack according to the invention, FIG. 15 is a further laboratory ware dispenser according to the invention, FIGS. 16*a*, 16*b* and 16*c* are views of steps in the assembly of the laboratory ware dispenser of FIG. 15, FIG. 17 is a receptacle with stand according to an embodiment of the invention, FIGS. 18*a*, 18*b*, 18*c* and 18*d* are exploded views of the lid assembly according to the invention, FIG. 19 is an exploded view of a laboratory ware magazine stack and a drive means of the invention, FIG. 20 is a detailed view of further laboratory ware dispenser of the invention with closure members, and FIG. 21 is an exploded view of a laboratory ware dispenser according to the present invention.

FIG. 1 shows a laboratory ware dispenser 10 comprising a receptacle 12 and a lid 14, which has a user operable closure means 16. The lid 14 is rotatable clockwise and counter-clockwise in relation to the receptacle 12, as indicated by the double-headed curved arrow. The closure means comprises a closure member 18 that can be moved linearly to and fro across the lid in the directions indicated by the double-headed straight arrow. A retaining member 20 helps keep the closure, member 18 in place on the lid. The lid 14 has two elements 22 extending from its upper surface for providing finger-tip rotation of the lid in relation to the receptacle. Also, the closure member 18 of the closure means has a portion 24 extending from its surface for providing finger-tip movement of the closure member 18 in relation to the aperture.

Referring now to FIG. 2, which is an exploded view of the dispenser 10 shown in FIG. 1, it can be seen that the receptacle 12 defines a substantially cylindrical space 26, which is covered by the circular footprint of the lid 14. In addition, the lid 14 comprises an annular body 28 having a screw threaded portion and a circular body 30, which releasably couples with the annular body by means of a snap-fit arrangement (not shown). The snap-fit arrangement allows for the rotation of the circular body 30 in relation to annular body 28 to provide for the rotation indicated by the curved double-headed arrow of FIG. 1. The circular body 30 supports the closure means 16 described in the immediately preceding paragraph. The lid 14 is coupled to the receptacle 12 by engagement of corresponding screw portions provided on the annular body 28 and the receptacle 12.

As shown in FIG. 2, a support member 32 is received within the cylindrical space 26 of the receptacle and, referring momentarily to FIG. 1, enclosed by the lid 14 when the lid engages with the receptacle. The support member 32 has a plurality of apertures 34, each aperture being of a diameter to receive an item of laboratory ware such as a pipette tip (not shown). The support member 32 also has a number of teeth 36 projecting from its outer edge, each of which is received in a corresponding groove 38 provided in the upper end of the receptacle. When the dispenser is closed (as shown in FIG. 1) the teeth 36 of the support member and the grooves 38 in the receptacle engage to inhibit rotation of the support member in the receptacle, which might otherwise occur when the body 30 of the lid is rotated.

FIG. 3 provides an exploded view of the lid shown in FIGS. 1 and 2. In common with the lid described above in relation to FIGS. 1 and 2, the lid 50 of FIG. 3 comprises an annular body 52 having a screw threaded portion and a circular body 54, which releasably couples with the annular body 52 by means of a snap-fit arrangement (not shown). The circular body 54 supports a closure means 56 (as described above) having a closure member 58 and a retaining member 60, both of which are shown in FIG. 3 detached from the circular body. An aperture 62 extends through the circular body. In use, the aperture is covered and uncovered by linear movement of the closure member 58 across the lid.

FIGS. 4 and 5 provide detailed views of the lid closure member 70 and lid retaining member 80 respectively. The lid closure member 70 comprises two snap-fit members 72 located towards opposing sides of the main part 74 of the closure member. The snap-fit members 72 releasably engage with the edges of the aperture 62 shown in FIG. 3 so as to allow for linear movement of the lid closure member 70 in relation to the aperture. The lid retaining member 80 comprises a retaining member main body 82 from which four snap-fit members 84 depend. The snap-fit members releasably engage with apertures 86 provided in the circular body (shown in FIG. 3). The retaining member main body 82 is shaped such that it defines a retaining aperture 86 when the retaining member main body 82 engages with the circular body.

FIG. 6 provides a detailed view from above of the support member shown in FIG. 2. As described above in relation to FIG. 3, the support member 90 comprises a plurality of apertures 92 each of which receives an item of laboratory ware such as a pipette tip. Four teeth 94 extend from the outer edge of the support member and, as described above, resist rotation of the support member when they are located in their corresponding grooves in the receptacle. Inspection of the apertures 92 of FIG. 6 reveals each to have two concentric rings which are indicative of the bore of each aperture having a non-uniform profile. This feature is described below with reference to FIG. 8.

FIG. 7 provides a detailed view from below of the support member shown in FIG. 2, i.e. FIG. 7 shows the support member of FIG. 6 when it is turned upside down. The component parts of the support member 90 of FIG. 7 are as described in the immediately preceding paragraph.

FIG. 8 provides a detailed view 100 in cross-section of the bore 102 of an aperture. A rim 104 is located towards one end of the bore and extends radially into the bore, thereby restricting the bore's diameter. The non-uniform nature of the bore diameter enables each aperture to receive an item of laboratory ware having a tapering body of a first maximum diameter when the support member is in the orientation shown in FIG. 6. When the support member is turned upside down, as shown in FIG. 7, each aperture can receive an item of laboratory ware having a tapering body of a second maximum diameter that is less than that of the first maximum diameter. Thus for example, when the support member is in the orientation shown in FIGS. 6 and 8 the apertures might receive blue pipette tips and in the upside-down orientation shown in FIG. 7 the apertures might receive narrower yellow pipette tips. Of course other items of laboratory ware having tapering bodies, such as pipette tips, can be accommodated in the support member.

The laboratory ware dispenser, including the support member is formed of polypropylene or polycarbonate. Thus, the laboratory ware dispenser can be autoclaved.

Prior to use of the laboratory ware dispenser of the invention, an item of laboratory ware, such as a pipette tip, is inserted into each of the apertures 34, 92 of the support member 32, 90. When the support member is fully populated with pipette tips, the support member is sterilised and then inserted into the receptacle 12. The lid 14 is then screwed onto the receptacle ensuring that the closure member 18, 58, 70 of the closure means 16 covers the aperture 62. These steps should be carried out in a sterile environment to minimise contamination of the pipette tips.

In use, the circular body 30, 54 is rotated in relation to the receptacle 12 as shown by the double headed curved arrow of FIG. 1 so that the aperture 62 is brought into registration with a batch of pipette tips. The closure member 18, 58, 70 of the closure means 16 is moved as shown by the double headed straight arrow of FIG. 1 to uncover the aperture 62 and allow for removal of the batch of pipette tips through the aperture. As the closure member 70 of the closure means is moved part of it passes through the retaining aperture 86, thereby hindering the lifting of the closure member from the lid. Referring to FIG. 4 it can be seen that the closure member 70 is held in place by a pair of snap-fit members 72, which are disposed towards one end of the closure member 70. Thus, it can be appreciated that the end of the closure member opposing the end bearing the snap-fit members 72 may be inclined to lift from the lid in use. Thus, the retaining member 20, 60, 80 can inhibit such lifting of the closure member. When the batch of pipette tips has been removed the closure member 18, 58, 70 of the closure means 16 is moved to cover the aperture again to minimise the risk of contamination. This process is repeated during the course of whatever laboratory or diagnostic procedure is being carried out as successive batches of pipette tips are required.

An alternative embodiment of a laboratory ware dispenser 110 is shown in FIGS. 9 and 10. The laboratory ware dispenser 110 comprises a receptacle 112 and a lid 114. The receptacle defines a substantially cylindrical space 116 within which is received a support member 118 configured to support a plurality of microtubes 120 in the same manner as described above. This embodiment is normally suited to the provision of a larger aperture than the first embodiment and thus is suited to use with comparatively larger items of laboratory ware, such as microtubes. The lid 114 is secured to the receptacle by means of a clip arrangement 122, which allows for rotation of the lid in relation to the receptacle. The lid 114 comprises a substantially circular body 124 which has teeth 126 around its outer edge. The teeth 126 engage with recesses (not shown) provided in the clip arrangement bearing part (not shown) of the lid 114. Also, the circular body 124 has an aperture 128 which when uncovered provides access to the pipette tips 120 received in the receptacle 112. A closure means 130 comprises a body 132 of substantially circular footprint, which rotates about a pivot point 134 attached to its outer edge.

In use, the embodiment of FIGS. 9 and 10 operates as described above with reference to FIGS. 1 to 8 to provide access to successive batches of pipette tips by rotation of the lid 114 and opening and closing of the closure means 130.

As an (un-illustrated) alternative to the lid and closure means arrangement of FIGS. 9 and 10, the closure member 132 may be of semi-circular footprint and of a size such that substantially half the area of the lid is covered. Movement of the closure member in relation to the lid is about a pivot point located towards the straight edge of the closure member and half way along its straight edge.

FIG. 11 is a representation of a laboratory ware dispenser 150. The dispenser 150 comprises an elongate body 152 which defines a substantially cylindrical space that receives and holds a plurality of support members (not shown), each of which supports a plurality of pipette tips 154. The support members are as described above in relation to the two embodiments of FIGS. 1 to 10. A thin support plate 156 helps keep the pipette tips of each support member in position.

Support member holding means 158 are used to hold the support members in place and to release a support member from the dispenser. Each support member holding means 158 comprises a body extending from the exterior into the cylindrical space and has a first end which engages with a support plate 156 and a second exterior end which is shaped for manual operation. The support member holding means also comprises biasing means (not shown), such as a spring, to keep the holding means in a first operating condition as shown in FIG. 11. In use, an operator grips the second end of the holding means to move the holding means against the spring bias from the first operating condition of FIG. 11 to a second operating condition in which a pipette tip bearing support member is released.

To maintain sterility of the pipette tips stored in and dispensed from the dispenser 150, a receptacle 112 of a laboratory ware dispenser (such as that of FIGS. 1 to 10) is inserted into the lower end of the dispenser to receive a released pipette bearing support member. Movement of the receptacle into the lower end of the dispenser is indicated by the arrows of FIG. 11.

The dispenser is formed of polypropylene or polycarbonate. Thus, the dispenser can be autoclaved.

FIG. 12 shows a laboratory ware magazine 200 comprising an annular support member 202 defining a cylindrical space 208. The annular support member 202 includes a plurality of circular apertures 206 extending around a circumference of annular support member 202.

The laboratory ware magazine 200 has a series of ware retaining members 212, provided by planar lugs extending radially outwardly of the annular support member 202 in a direction perpendicular to the top and/or bottom end planes of the cylindrical space 208 defined by the annular support member 202. The ware retaining members 212 provide a valve which acts to retain an item of laboratory ware 204 in the aperture 206 such that the item does not fall out of the aperture under the action of gravity. Each aperture has a pair of ware retaining members, or lips, 212 located at opposing sides thereof. One retaining member may serve as a retaining member for two adjacent apertures 206.

The ware retaining members 212 are configured to retain a pipette tip 204 in the annular support member 202 thereby preventing spillage of the item from the laboratory ware magazine 200 due to the effects of gravity.

The laboratory ware magazine 200 depicted in FIG. 12 has a support rim 214*a* coupling a plurality of ware retaining members 212 whilst not hindering access to the apertures 206. The support rim 214*a* is located in parallel configuration with the top end plane of the cylindrical space 208 defined by the annular support member 202 and is of annular configuration. The support rim 214*a* forms a flange which extends radially outwardly of, and is perpendicular to, the circumferential surface of the annular support member 202.

The laboratory ware magazine 200 has a further support rim 214*b*, of annular configuration and of different diameter to support rim 214*a*, further coupling a plurality of ware retaining members 212. The two support rims 214*a* and 214*b* are in parallel configuration with one another and also with the top and the bottom end planes of the cylindrical space 208 defined by the annular support member 202.

The laboratory ware magazine 200 further comprises magazine retaining means 216 which engage with a further laboratory ware magazine 200 (not shown) in a releaseable coupling. In the particular arrangement depicted in FIG. 12, the laboratory ware magazine 200 comprises magazine retaining means 216 which engage with the magazine retaining means 216 of the further laboratory ware magazine (not shown) in a tongue-and-groove arrangement.

The magazine retaining means 216 are arranged on flange 214*a* of the annular support member 202, the flange 214*a* being directed radially outwardly of the annular support member 202. In an alternative arrangement (not shown), the flange 214*a* may be directed radially inwardly of the annular support member 202.

The magazine retaining means 216 comprise opposing magazine retaining members including a tongue arranged on the first flange 214*a* of the annular support member 202 and of a groove arranged on a second flange (shown as support rim 214*c* in FIG. 13) of the annular support member 202.

In use, an item of laboratory ware 204 such as a pipette tip is located and retained in an aperture 206. The pipette tip 204 is directed radially inwardly of the annular support member 202 such that it projects into the cylindrical space 208 defined by the annular support member 202. The pipette tip 204 will project towards the centre point 210 of the space 208 defined by the annular support member 202 such that the body of tip 204 is retained within the cylindrical space 208 bounded by the top and bottom end planes and the circumferential surface.

The laboratory ware magazine 200 receives and retains an array of pipette tips 204 within the space 208 defined by the annular member 202. The array of pipette tips 204 are retained such that they do not project radially outwardly of the annular support member 202 beyond the extent of the ware retaining members 212. Thus, the array is retained within the outer radial bounds of the laboratory ware magazine 200.

In the embodiment of the present invention depicted in FIG. 12, the width dimension of the annular support member 202 provides for a single circumference therearound and, thus, for a single array of pipette tips 204 around the annular support member 202.

The width dimension of the annular support member 202 may alternatively comprise a plurality of circumferences, each circumference having a plurality of apertures 206 arranged thereabout. In the alternative arrangement the laboratory ware magazine 200 comprises a series of arrays of pipette tips 204 arranged around the annular support member 202, each array being arranged around a single circumference, the arrays being in parallel configuration with one another.

The scalability of the width dimension of the annular support member 202, and the number and size of apertures 206 around a circumference of the annular support member 202 are a matter of design choice and will depend upon the number and size of the item/items to be retained within the aperture 206.

A laboratory ware magazine 200 of circular footprint maximises the storage capacity of the magazine relative to the size of its footprint.

The magazine retaining means 216 of laboratory ware magazine 200 are comprised of opposing magazine retaining members 216, such that the magazine retaining member 216 of a first laboratory ware magazine 200 is engaged with an opposing magazine retaining member 216 on an adjacent laboratory ware magazine (not shown) so as to couple together adjacent laboratory ware magazines. Thus, for example, a first magazine retaining member 216 of a first flange 214*a* of an annular support member 202 is engaged with a second magazine retaining member of a second flange of an adjacent annular support member (not shown) thereby coupling the adjacent laboratory ware magazines. Thus, a tongue from a first laboratory ware magazine 200 is engaged with a groove from a second laboratory ware magazine 200 thereby forming a laboratory ware magazine stack.

The laboratory ware magazine 200 is capable of interlocking with similar or identical laboratory ware magazines 200 in order to create a laboratory ware magazine stack. The laboratory ware magazine stack can be of any desired storage capacity as the number of interlocking laboratory ware magazines may be selected by the user/machine.

As shown in FIG. 13, the laboratory ware magazine 200 comprises a further support rim 214*c* located at a bottom end of the cylindrical space 208 defined by the annular support member 202, the further support rim 214*c* being in parallel configuration with the support rim(s) 214*a*, 214*b*. The support rim 214*c* has an annular configuration and couples a plurality of ware retaining members 212. The support rim 214*c* further strengthens and supports the laboratory ware magazine 200 and ware retaining members 212 respectively.

The laboratory ware magazine 200 further comprises a detent 218 configured to provide accurate radial positioning of the laboratory ware magazine 200 within a receptacle (not shown).

The laboratory ware magazine 200 even further comprises an alignment means 220 to enable repeatable positional placement of one laboratory ware magazine 200 relative to another. The alignment means 220 comprises a series of lugs projecting radially inwardly from the annular support member 202, thus being visible in the space 208. The lug 220 projects radially inwardly of the annular support member 202, in a plane parallel to the top and bottom end planes of the cylindrical space 208 defined by the annular support member, into the space 208 defined thereby so as to be visible in the space 208. During assembly of a plurality of laboratory ware magazines 200, the magazines are brought into proximity with one another and, are positioned and orientated correctly relative to one another by way of aligning the alignment means 220 of each laboratory ware magazine 200 before being engaged with one another.

Alternative alignment means 220 may be in the form of a detent, for example, located on a support rim 214 of a first annular support member 202 and a corresponding indent provided on a support rim 214 of a second annular support member 202 (not shown), the detent and indent being positioned on their respective rims 214 so as to engage with one another when the adjacent rims 214 of the annular support members 202 are correctly aligned with one another. Other suitable alignment means will be known to the skilled artisan and may include a pin and hole arrangement, for example.

The alignment means 220 is useful when the laboratory ware magazine 200 or laboratory ware magazine stack 230 is used in a robotic application as the alignment can be done, repeatably and accurately, by the machine.

FIG. 14 shows a laboratory ware magazine stack 230 comprising a plurality of laboratory ware magazines 200. Each of the laboratory ware magazines is as described with reference to FIGS. 12 and 13.

The space 232 defined by the laboratory ware magazine stack 230 is cylindrical and bounded by top and bottom end planes and the circumferential surfaces provided by the annular support members 202 of the laboratory ware magazines 200 from which the laboratory ware magazine stack is comprised. The top and bottom planes are parallel with one another.

The laboratory ware magazine stack 230 comprises 12 laboratory ware magazines 200 arranged in alignment with one another along an axis (A) formed longitudinally through the centre points 210 of the cylindrical spaces 208 defined by each annular support member 202. By way of the axial alignment of a plurality of laboratory ware magazines 200 an elongate cylindrical laboratory ware magazine stack 230 is formed.

The circumferential surface of the elongate laboratory ware magazine stack 230 has a width dimension comprised of the sum of the width dimensions of each of the laboratory ware magazines 200 which comprise the laboratory ware magazine stack 230. In the laboratory ware magazine stack 230 depicted in FIG. 14, each laboratory ware magazine 200 has an equal width dimension, although it will be readily understood that the laboratory ware magazines 200 within the laboratory ware magazine stack 230 can have unequal width dimensions.

Each and all of the laboratory ware magazines 200 within the laboratory ware magazine stack 230 have an equal annular diameter, although alternatively the laboratory ware magazines 200 may have unequal annular diameters.

In the latter arrangement (not shown), the laboratory ware magazine stack 230 will have a frustoconical shape and will define a frustoconical space 232.

It will be understood that the number and annular diameter of laboratory ware magazines 200 configured to provide the laboratory ware magazine stack 230 of the invention will be a matter of design choice and can be selected to provide a laboratory ware magazine stack 230 of any desired storage capacity. For example, when the laboratory ware magazine stack is configured for use in a robotic, automated machine, the required storage capacity will be larger than if the laboratory ware magazine stack is configured for use by an individual consumer at a work bench.

Within the laboratory ware magazine stack 230 of FIG. 14, each laboratory ware magazine 200 comprises magazine retaining means 216, in the form of a tongue and groove arrangement, configured to engage with magazine retaining means of an adjacent laboratory ware magazine 200.

The magazine retaining means 216 may be configured to provide for releasable coupling or, alternatively, may be configured to provide for fixed coupling of adjacent laboratory ware magazines 200. In the latter configuration it will be understood that once the magazine retaining means 216 have been engaged for a first time, the adjacent laboratory ware magazines 200 will effectively be locked together.

The magazine retaining means 216 are arranged on flanges 214*a* of each annular support member 202, the flanges 214*a* being directed radially outwardly of the annular support members 202.

In an alternative arrangement (not shown) the flange 214*a* is provided by one or more lugs extending radially inwardly and/or outwardly of the annular support member 202. When there is more than one lug, the lugs are preferably circumferentially spaced from one another around the annular support member 202.

Within the laboratory ware magazine stack 230, as depicted in FIG. 14, the magazine retaining means 216 of a laboratory ware magazine 200 is comprised of opposing magazine retaining members 216 wherein the first flange 214*a* of the annular support member 202 comprises a first magazine retaining member, a tongue for example, and the second flange (not shown) of the annular support member 202 comprises a second magazine retaining member, a groove for example. (not shown), the first and/or second magazine retaining member 216 engaging with an opposing magazine retaining member 216 on an adjacent laboratory ware magazine 200 so as to couple together adjacent laboratory ware magazines, thereby forming the laboratory ware magazine stack.

Other suitable magazine retaining means will be well known to those skilled in the art and may comprise a thread and screw arrangement, or a pin and hole arrangement, for example.

FIGS. 15 and 16*a*, 16*b* and 16*c* show a laboratory ware dispenser 240, comprising a receptacle 242 defining a space 246 and 12 laboratory ware magazines 200 forming a laboratory ware magazine stack 230 and having a plurality of apertures 206 for containing items of laboratory ware 204 such as pipette tips, for example. The cylindrical space 246 defined by the receptacle 242 is configured to receive the laboratory ware magazines 200 in the form of a laboratory ware magazine stack 230. The receptacle 242 has 12 apertures 244 in a surface thereof with each of the apertures 244 dimensioned such that one of the apertures 206 of a laboratory ware magazine 200 is registerable with the aperture 244 of the receptacle 242 upon relative rotation of the receptacle 242 and laboratory ware magazine stack 230.

In use, the registration of an aperture 206 of a laboratory ware magazine 200 and an aperture 244 in the receptacle 242 allows selective removal a pipette tip 204.

The receptacle 242 provides a cylindrical container for a laboratory ware magazine stack 230. The receptacle 242 is open at a first end 250, has a circumferential outer surface and a bottom wall 248, the bottom wall 248 closing the container at a second end. The first and second ends 250, 248 are parallel with one another.

The receptacle 242 has a plurality of apertures 244. The plurality of apertures 244 are arranged longitudinally of the receptacle 242 in alignment with one another on an axis parallel to the longitudinal axis (B) of the cylinder defined by the receptacle 242. The apertures 244 provide access to the space 246 defined by the receptacle 242. Each of the apertures 244 of the receptacle 242 registers with an aperture 206 in a laboratory ware magazine 200 within the laboratory ware magazine stack 230 within the receptacle 242 upon relative rotation of the receptacle 242 and laboratory ware magazine stack 230.

As shown in FIG. 17, the receptacle 242 preferably comprises 2 rows of apertures 244. Each row has a 12 apertures 244 arranged in longitudinal alignment with one another on an axis (B) parallel to the longitudinal axis of the cylinder defined by the receptacle 242.

The rows of apertures 244 are circumferentially spaced from one another in the outer surface of the receptacle 242. In a preferred arrangement the rows are circumferentially spaced such that at least one row of apertures is easily accessible to a user (or an automated machine) by left-handed or right-handed operation, thus, the contents of the laboratory ware dispenser 240 are equally accessible regardless of the handedness of the user.

The laboratory ware dispenser 240 (as shown in FIGS. 15 and 16) comprises a receptacle 242 having fewer apertures 244 than the laboratory ware magazine stack 230 such that a population of 12 apertures 206 in the laboratory ware magazine stack 230 are brought into registration with 12 apertures 244 in the receptacle 242 in order to provide access to the pipette tips 204 retained within the laboratory ware magazine stack 230. Successive populations of 12 apertures 206 in the laboratory ware magazine stack 230 are brought into registration with the 12 apertures 244 in the receptacle upon relative rotation of the receptacle 242 and the laboratory ware magazine stack 230 to allow for removal of successive batches of pipette tips 204 through the apertures 244.

In a preferred embodiment of the present invention utilising the receptacle 242 depicted in FIG. 17, the two rows of apertures 244 in the receptacle 242 are registerable with two rows of longitudinally aligned apertures 206 in a laboratory ware magazine stack 230 received within the receptacle 242.

In an alternative arrangement (not shown) the receptacle 242 has apertures 244 corresponding in number to those in the laboratory ware magazine stack 230 and being contemporaneously registerable therewith. In this alternative embodiment, access to each and all of the items 204 retained within the laboratory ware magazine stack 230 may be achieved at the same time.

As shown in FIGS. 18*a*, 18*b*, 18*c*, 18*d* and 19 the laboratory ware dispenser 240 has a lid assembly generally denoted by the reference numeral 260, which covers the space 246 provided by the receptacle 242 and closes the first, open end 250 thereof.

The lid assembly 260 is configured to engage with the laboratory ware magazine stack 230 contained within the receptacle 242 so as to provide for relative rotation of the receptacle 242 and the laboratory ware stack 230.

In the embodiment of the present invention depicted in FIGS. 18*a*-18*d* and FIG. 19 the lid assembly 260 comprises a lid 262, a rotation facilitation device 266 and a drive means 264. The rotation facilitation device 266 is a drive plate which engages with the magazine retaining means 216 of the uppermost laboratory ware magazine 200 in laboratory ware stack 230, such that there is no relative rotation between the drive plate and the laboratory ware stack 230. Engagement of the drive plate with the magazine retaining means 216 may be by tongue-and-groove arrangement. The lid 262 engages with the receptacle 242 such that there is no relative rotation between lid 262 and receptacle 242. The drive means 264, in this arrangement a hand wheel, is received by the lid 262 and is rotatable relative to the lid 262. The hand wheel further engages with the drive plate so as to provide relative rotation of the lid 262/receptacle 242 and the drive means 264/drive plate 266/laboratory ware magazine stack 230.

The lid assembly 260 further comprises a gasket seal 268 which is located between the lid 262 and the receptacle 242 whereby a contamination seal is provided and maintained during use of the laboratory ware dispenser 240.

The lid 260 has attachment means 270 which are a series of latches arranged around the perimeter of the lid. In an alternative arrangement (not shown), the attachment means 270 may be a screw and thread arrangement. Any attachment means suitable for maintaining the receptacle 242 and the lid 260 in engagement with one another whilst allowing no relative rotation thereof are suitable for use in the present invention.

The lid assembly 260 further comprises ejection means 272 in the form of a push-button to allow the laboratory ware magazine stack 230 to be ejected from the lid assembly 260 after use. As shown in FIGS. 18*a* and 20, the ejection means 272 is preferably located as an ejection button in the centre of the drive means 264 which push-button is depressed to eject the laboratory ware magazine stack 230. The ejection means 272 provides linear movement of the laboratory ware magazine stack 230 in a direction perpendicular to the plane of the lid assembly 260 and away from the lid assembly. The ejection means facilitates quick and easy removal of a laboratory ware magazine stack 230 which has been emptied of its contents before a full laboratory ware magazine stack 230 is located in the re-useable receptacle 242.

The laboratory ware dispenser 240 of FIG. 19 further comprises a stand 282 by which the dispenser can be placed on a planar surface, a work area for example. The stand 282 is located on the dispenser 240 so as not to impair access to the pipette tips 204 therein.

As shown in FIG. 20, the laboratory ware dispenser 240 has a closure means 280 operable to cover and uncover at least one aperture 244 in the receptacle 242. In the depicted arrangement, the closure means 280 is provided by 12 rotatable seal covers, each cover being moveable around the circumferential surface of the receptacle 242 to cover and uncover one of the apertures 244 in a row of apertures in the receptacle 242, thus, each aperture 244 in a row of apertures in the receptacle 242 may be covered and uncovered either individually or in any combination. For example, any number of apertures 244 in the row of apertures in the receptacle 242 between 0 and 12 may be covered and uncovered at any one time.

The rotatable seal cover(s) may have a guide rail or rails to provide for accurate location of the seal around the receptacle body.

The closure means 280 is an open C-shaped cover, thus enabling a snap fit on to the receptacle body. When the receptacle 242 has two rows of apertures 244, each C-shaped cover is operable to cover and uncover two apertures 244, one-aperture in each of the rows of apertures. The closure member 280 is rotated clockwise or anti-clockwise to uncover the aperture 244 and the rotational movement reversed to cover the aperture 244 again.

In use, the laboratory ware magazine stack 230 is rotated relative to the receptacle 242 by rotation of the hand wheel 264 so that at least one aperture 244 in the receptacle registers with at least one aperture 206 in the laboratory ware magazine stack 230. A user or automated machine then rotates the closure means 280 around the circumference of the receptacle 242 to uncover the aperture 244 in the receptacle 242 to allow for removal of a pipette tip 204 form the dispenser 240. After removal of the pipette tip 204 the closure means 280 is rotated in the opposite direction to cover the aperture 244 again and minimise the risk of contamination of the remaining pipette tips 204 in the laboratory ware dispenser 240. This operation can be repeated to gain access to successive items of laboratory ware.

The laboratory ware magazine 200 or laboratory ware magazine stack 230 receivable by the receptacle 242 may further comprise a detent 218 (as shown in FIG. 13) configured to provide radial positioning of the laboratory ware magazine 200 or laboratory ware magazine stack 230 within the receptacle 242.

The detent 218 provide a user with an audible feedback to indicate registration of an aperture 244 of the receptacle 242 with an aperture 206 of a laboratory ware magazine 200 or laboratory ware magazine stack 230 within the receptacle 242. The audible feedback may, for example, indicate the registration of the next longitudinal row of apertures 206 of the laboratory ware magazine stack 230 with the row of apertures 244 in the receptacle 242.

FIG. 21 shows a laboratory ware dispenser 240 in exploded view such that the component parts thereof are visible. In use, the lid assembly 260 incorporating the drive ring 266, the gasket seal 268, lid 262 and the hand wheel 264 are coupled to the uppermost laboratory ware magazine 200 in laboratory ware magazine stack 230 utilising the magazine retaining means 216 of the laboratory ware magazine. The laboratory ware magazine stack 230 and lid assembly 260 are located in receptacle 242 using alignment means (not shown).

The lid assembly 260 is then attached to the receptacle 242 by way of latches 270 such that relative rotation of the laboratory ware magazine stack 230 and the receptacle 242 is provided by operation of the hand wheel 264. Upon rotation of the laboratory ware magazine stack 230, a row of apertures 206 in laboratory ware magazine stack 230 is brought into registration with apertures 244 in the receptacle 242. A pipette tip 204 is then removable through the aperture 244. When access to one or more apertures 244 in the receptacle is required, the apertures 244 are covered and uncovered by closure members 280 in the form of open C-shaped covers. The covers 280 are equal in number to the number of apertures 244 in a longitudinal row of apertures 244 in the receptacle 242 and extend around the circumferential surface of the receptacle 242 to cover/uncover one or both longitudinal rows of apertures 244. Each cover 280 is individually operable to cover/uncover an aperture in one or each row of apertures in receptacle 242, although the user or automated machine may operate more than one cover 280 at any one time in order to uncover the desired number of apertures 244 and, thus, provide access to one or more pipette tips 204.

The laboratory ware magazine, laboratory ware magazine stack and laboratory ware dispenser is preferably of a plastics material resistant to autoclaving and/or to gamma irradiation, such that they are capable of sterilisation.

Further, to avoid contamination, the laboratory ware magazine, laboratory ware magazine stack and/or laboratory ware dispenser may be wrapped in a protective material, such as cellophane, for example prior to use.

It is envisaged that the laboratory ware magazine, laboratory ware magazine stack and laboratory ware dispenser of the present invention are suitable for applications in both manual and automated use.

The invention claimed is:

1. A laboratory ware magazine comprising:

an annular support member defining a space for containing a plurality of items of laboratory ware, wherein the annular support member defines a plurality of bores extending through the annular support member, each bore being of non-uniform diameter along its length for receiving an item of laboratory ware, wherein each bore defines a rim extending radially into the bore and located towards one end of the bore;

a plurality of apertures arranged around a circumference of the annular support member, each aperture being adapted to receive an item of laboratory ware; and each of said apertures being configured such that an item of laboratory ware placed in the aperture is directed radially inwardly of the annular support member into the space and is retained in the aperture.

2. A laboratory ware magazine according to claim 1, wherein the space defined by the annular support member is cylindrical and is bounded by top and bottom end planes and a circumferential surface provided by the annular support member.

3. A laboratory ware magazine according to claim 1, further comprising ware retaining members extending radially of the annular support member.

4. A laboratory ware magazine according to claim 3, wherein the ware retaining members are planar lugs arranged to project radially outwardly of the circumferential surface of the annular support member in a plane perpendicular to the top and/or bottom end planes of the cylindrical space defined by the annular support member.

5. A laboratory ware magazine according to claim 1, further comprising a plurality of ware retaining members and a support rim arranged to couple said ware retaining members.

6. A laboratory ware magazine according to claim 5, wherein the support rim is of annular configuration.

7. A laboratory ware magazine according to claim 5, wherein the support rim forms a flange which extends radially outwardly of, and is perpendicular to, an outer circumferential surface of the annular support member.

8. A laboratory ware magazine according to claim 1, comprising a plurality of ware retaining members and a plurality of support rims arranged to couple said ware retaining members.

9. A laboratory ware magazine according to claim 1, comprising a plurality of circumferences, each circumference having a plurality of apertures arranged thereabout.

10. A laboratory ware magazine according to claim 9, wherein the apertures in adjacent circumferences are axially aligned with one another along a longitudinal axis parallel to the longitudinal axis of the cylindrical space defined by the annular support member and perpendicular to the top and/or bottom end planes of the cylindrical space.

11. A laboratory ware magazine according to claim 1, comprising magazine retaining means configured to engage with at least one additional laboratory ware magazine.

12. A laboratory ware magazine according to claim 11, wherein the magazine retaining means are configured to engage with the magazine retaining means of the at least one additional laboratory ware magazine.

13. A laboratory ware magazine according to claim 11, wherein the magazine retaining means is located on a flange of the laboratory ware magazine, the flange being directed radially inwardly or outwardly of the annular support member.

14. A laboratory ware magazine according to claim 13, comprising a first and a second flange each extending radially with respect to the annular support member.

15. A laboratory ware magazine according to claim 14, wherein at least one of said first and second flange extends radially inward.

16. A laboratory ware magazine according to claim 14, wherein the first and the second flanges are arranged adjacent to the top and bottom ends of the cylinder provided by the annular support member.

17. A laboratory ware magazine according to claim 12, wherein the magazine retaining means are comprised of opposing magazine retaining members wherein a first flange of the annular support member comprises a first magazine retaining member and a second flange of the annular support member comprises a second magazine retaining member, the first and/or second magazine retaining member being engageable with an opposing magazine retaining member on an adjacent laboratory ware magazine so as to couple together adjacent laboratory ware magazines.

18. A laboratory ware magazine according to claim 1, further comprising a detent configured to provide radial positioning of the laboratory ware magazine within a receptacle.

19. A laboratory ware magazine according to claim 1, further comprising an alignment means configured to enable positional placement of one laboratory ware magazine relative to another.

* * * * *